United States Patent [19]

Nezu

[11] Patent Number: 4,963,934

[45] Date of Patent: Oct. 16, 1990

[54] IMAGE FORMING APPARATUS CAPABLE OF SHORTENING DOCUMENT SIZE DETECTION TIME

[75] Inventor: Yukihiro Nezu, Tokyo, Japan

[73] Assignee: Kabushiki Kaisha Toshiba, Kawasaki, Japan

[21] Appl. No.: 326,000

[22] Filed: Mar. 20, 1989

[30] Foreign Application Priority Data

Mar. 23, 1988 [JP] Japan ..... 63-68386
Apr. 30, 1988 [JP] Japan ..... 63-108463

[51] Int. Cl.[5] ..... G03G 15/00

[52] U.S. Cl. ..... 355/235; 355/77; 355/243; 355/311; 355/55; 355/75

[58] Field of Search ..... 355/243, 235, 233, 55, 355/57, 77, 311, 75

[56] References Cited

U.S. PATENT DOCUMENTS 4,615,610 10/1986 Yoshiura ..... 355/210
4,645,328 2/1987 Shiraki et al. ..... 355/233 X
4,692,019 9/1987 Morimoto et al. ..... 355/243 X
4,695,154 9/1987 Watanabe ..... 355/243 X
4,708,486 11/1987 Watanabe ..... 355/233 X

*Primary Examiner*—R. L. Moses
*Attorney, Agent, or Firm*—Foley & Lardner, Schwartz, Jeffery, Schwaab, Mack, Blumenthal & Evans

[57] ABSTRACT

An image forming apparatus for forming an image on a flat image carrier having a size corresponding to a size of a document, includes a scanner for optically scanning the document to obtain an image of the document after the scanner has moved from a home position to a start position for scanning. A detector detects whether the document is at the home position. A processor determines the size of the document during the movement of the scanner away from the start position when the presence of the document is detected at the home position, and during the movement of the scanner toward the start position when the absence of the document is detected at the home position. The image of the document is formed on the image carrier in accordance with the size of the document determined by the processor.

16 Claims, 24 Drawing Sheets

| DETECTION POSITION / DE-TECTOR / DOCUMENT SIZE | T | | U | | V | | W | | X | | Y | | Z | |
|---|---|---|---|---|---|---|---|---|---|---|---|---|---|---|
| | 63a | 63b | 63a | 63b | 63a | 63b | 63a | 63b | 63a | 63b | 63a | 63b | 63a | 63b |
| A3 | ○ | ○ | ○ | ○ | ○ | ○ | ○ | ○ | ○ | ○ | ○ | ○ | ○ | ○ |
| B4 | ○ | ○ | ○ | ○ | ○ | ○ | ○ | ○ | ○ | ○ | ○ | ○ | × | × |
| LATERAL A4 | × | ○ | × | ○ | × | ○ | × | ○ | × | ○ | × | × | × | × |
| LATERAL B5 | × | ○ | × | ○ | × | ○ | × | ○ | × | × | × | × | × | × |
| LONGITUDINAL A4 | ○ | ○ | ○ | ○ | ○ | ○ | × | × | × | × | × | × | × | × |
| LONGITUDINAL B5 | ○ | ○ | ○ | ○ | × | × | × | × | × | × | × | × | × | × |
| LATERAL A5 | × | ○ | × | ○ | × | ○ | × | × | × | × | × | × | × | × |
| LONGITUDINAL A5 | × | ○ | × | × | × | × | × | × | × | × | × | × | × | × |

FIG. 11

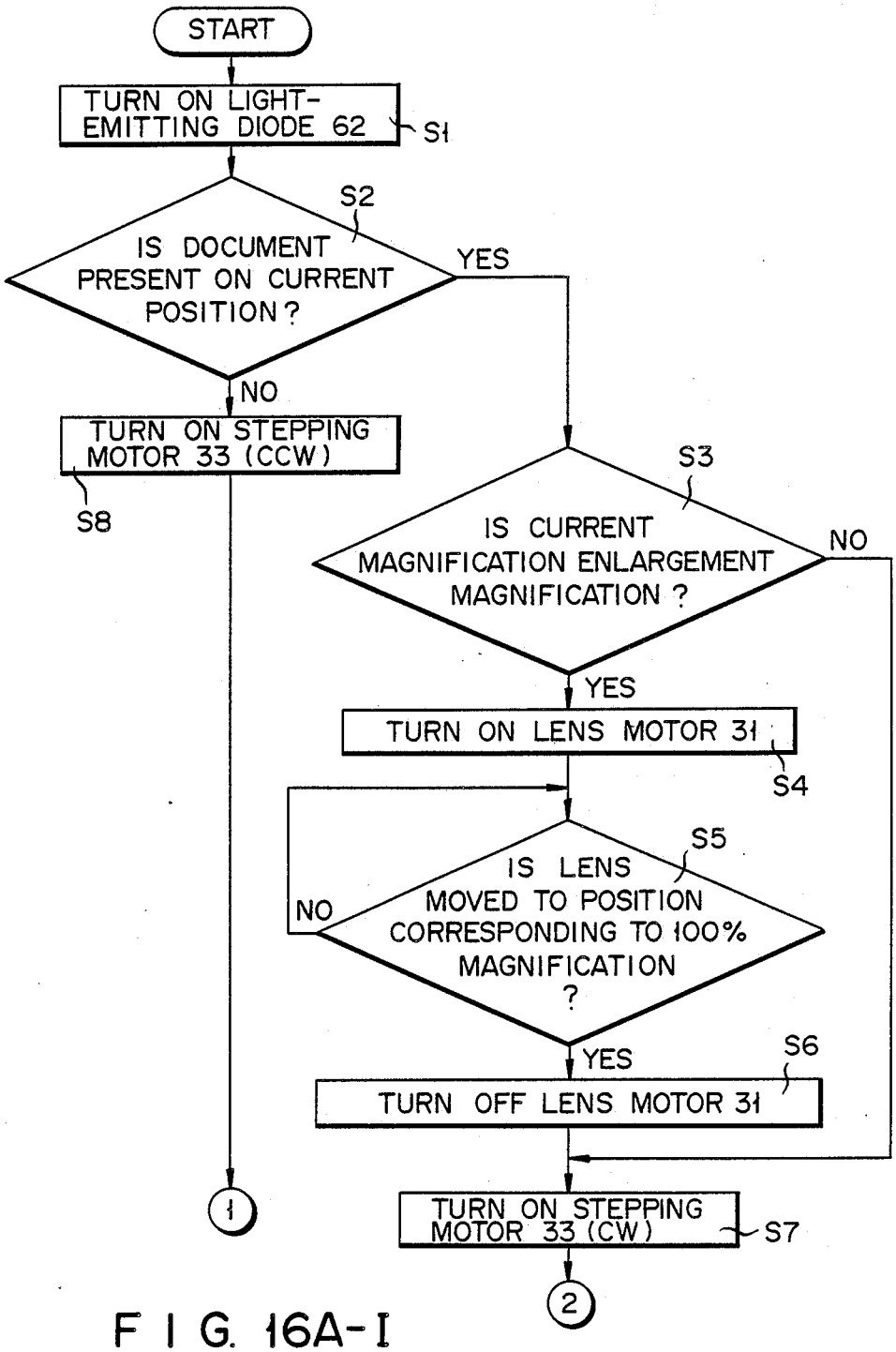
FIG. 16A-I

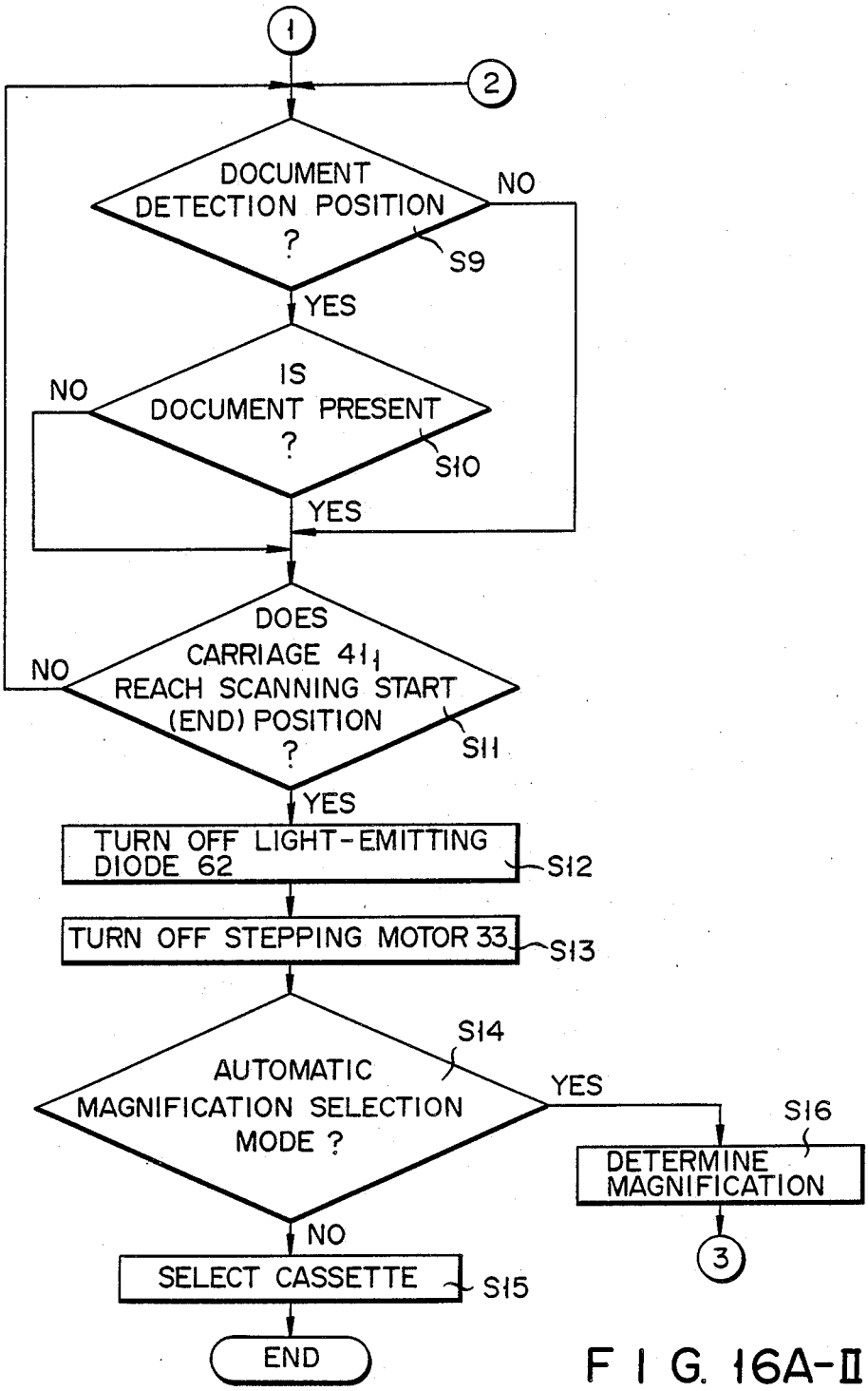
FIG. 16A-II

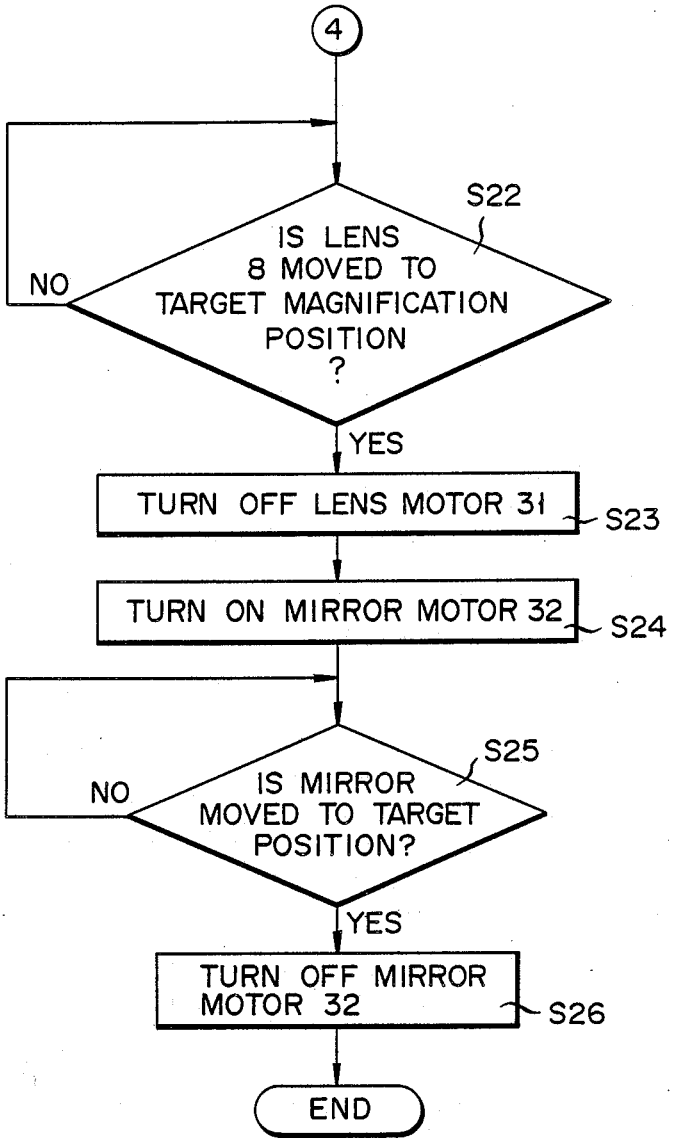
F I G. 16B-II

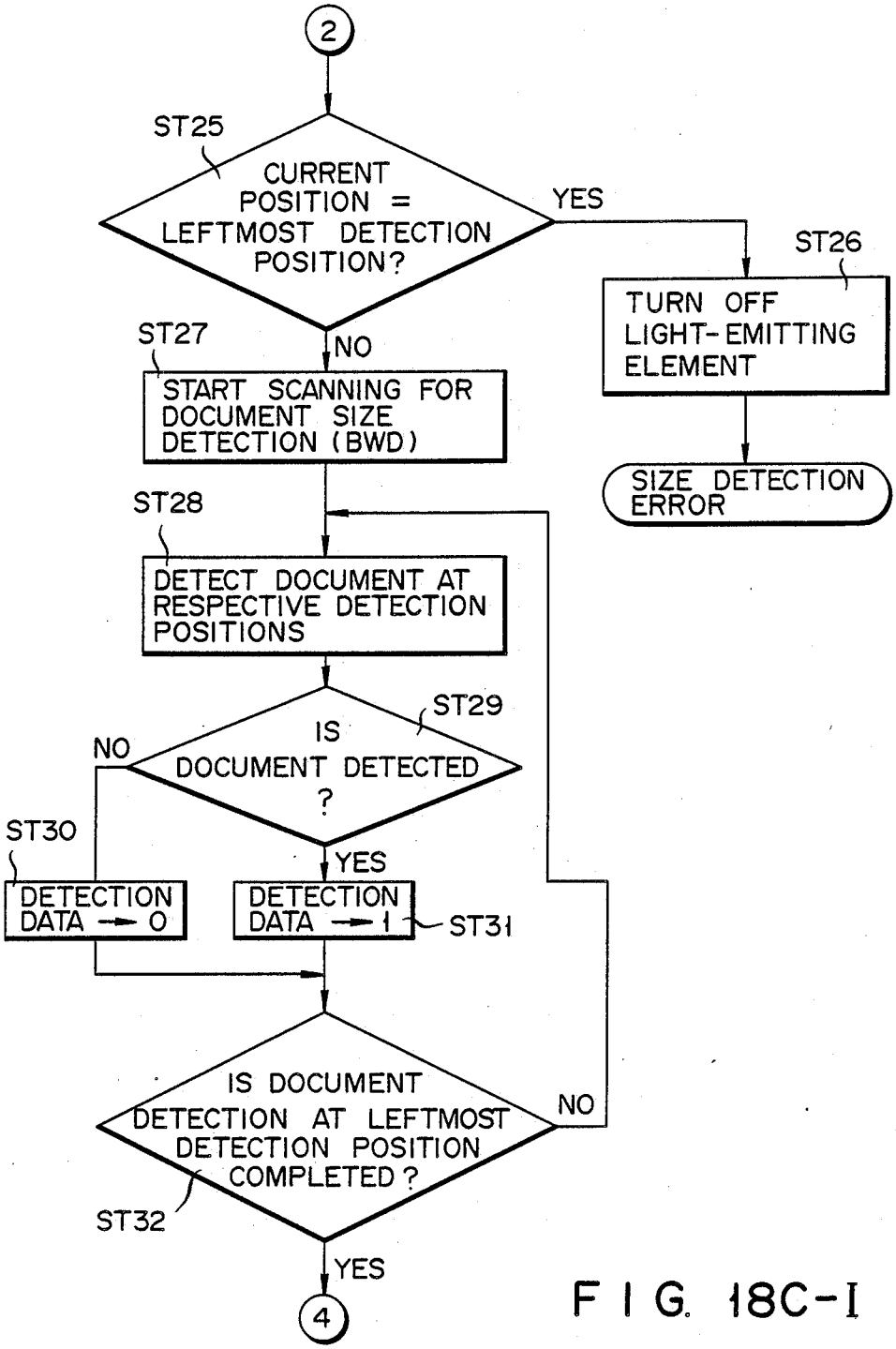
FIG. 18C-I

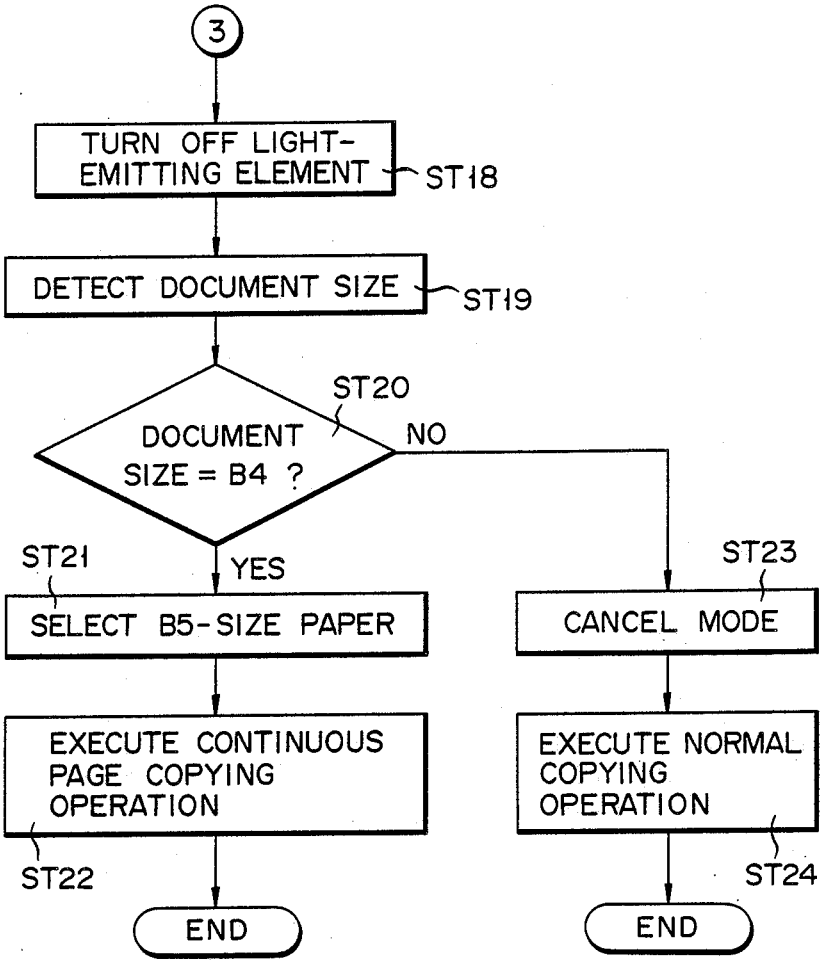
F I G. 18B-II

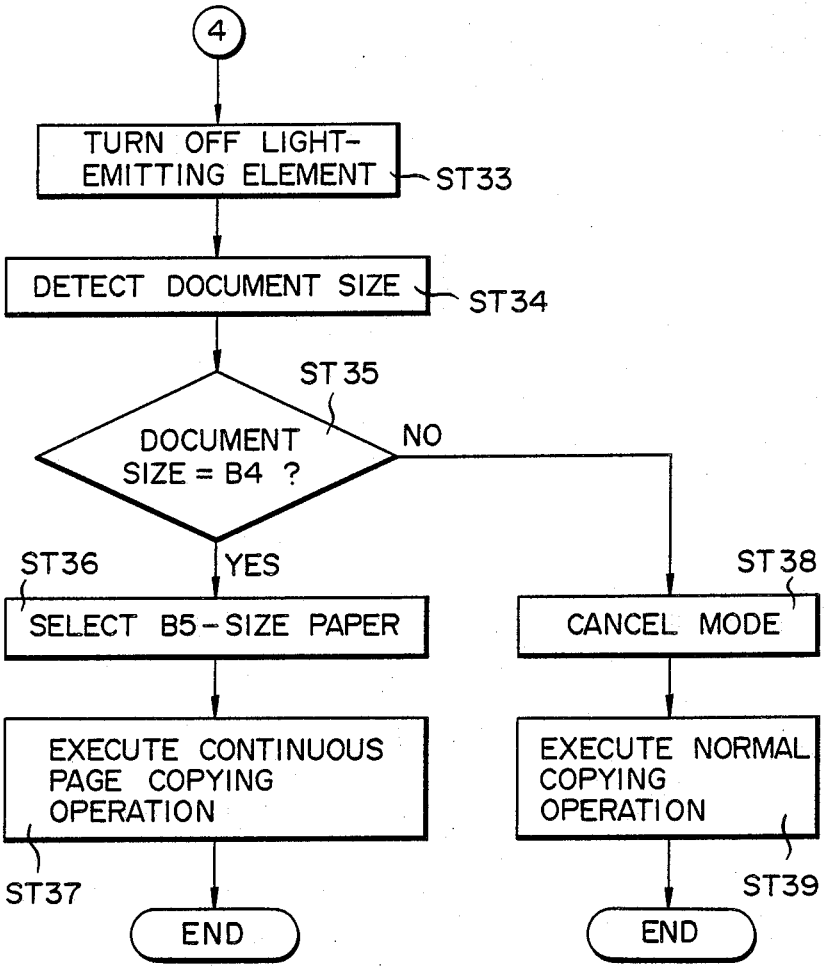
FIG. 18C-II

IMAGE FORMING APPARATUS CAPABLE OF SHORTENING DOCUMENT SIZE DETECTION TIME

BACKGROUND OF THE INVENTION

1. Field of the Invention

The present invention relates to an image forming apparatus and, more particularly, to an image forming apparatus capable of shortening a document size detection time.

2. Description of the Related Art

As a typical image forming apparatus, an electronic copying machine can be used. The electronic copying machine has a scanning unit for scanning a document. The scanning unit is provided with a carriage. During a copying operation, the scanning unit is moved by the carriage to a predetermined position (or a home position according to a magnification) in accordance with a paper size or a copying magnification. Normally, since the scanning unit is provided with an scale indicator, a distance from a scanning start position to the home position can be detected using the scale. This distance represents a copying range determined in correspondence with the size of a copy paper sheet on which a document image is to be formed. Then, the size of a placed document is detected in order to perform a copying operation according to a magnification. In this case, the scanning unit is moved from the home position (position indicating a copying range) to the scanning start position. Thereafter, an end portion of the document is detected while moving the scanning unit from the scanning start position in the scanning direction, thus determining a document size.

However, such document detection requires much time since the scanning unit is once returned to :he scanning start position and is then moved therefrom in the scanning direction.

A so-called continuous page copying operation is sometimes performed using the above-mentioned electronic copying machine in order to obtain copies of two open pages. In a copying machine having a continuous page copying function, images can be formed on corresponding copy paper sheets from two documents by depressing a copy key once after the continuous page copying mode is selected, without using optional equipment such as an automatic document feeder. However, when a normal copying operation is to be executed after the continuous page copying operation, an operator often may not cancel the continuous page copying mode. In this case in the above-mentioned document size detection method, the continuous page copying function is not automatically canceled, and a new continuous page copying operation is executed. Thus, a copying operation is performed for the second imaginary document. Therefore, an unnecessary blank copy is outputted.

SUMMARY OF THE INVENTION

It is therefore an object of the present invention to provide an image forming apparatus which can shorten the time required for detecting a document size during a copying operation.

It is another object of the present invention to provide an image forming apparatus which can automatically cancel a continuous page copying function.

It is still another object of the invention to provide an image forming system with means for measuring the size of paper to receive the image by scanning the image bearing document prior to transferring the image.

It is a further object of the invention to provide an image forming system in which the size of the carrier receiving the image is determined by measuring the size of the image bearing document It is a further object of the invention to provide a method for operating an image forming apparatus in which the size of the document providing the image is measured by a scanning means and the proper sized image carrier selected to receive the image.

It is another object of the invention to provide a method for creating an image on an image carrier by measuring the size of the document from which the image will be taken, this measurement being effected by the use of photodetectors to scan and calculate the document size on the basis of reflected signals from the document, selecting an image carrier size on the basis of the scanning information and operating the scanning means to place the image on the image carrier.

One object of the present invention can be achieved by an image forming apparatus for forming an image on a flat image carrier having a size corresponding to a size of a document, comprising means for optically scanning the document to obtain an image of the document after the scanning means has moved from a home position to a start position for scanning, means for detecting whether the document is at the home position, means for determining the size of the document during the movement of the scanning means away from the start position when the presence of the document is detected at the home position by the detecting means, and during the movement of the scanning means toward the start position when the absence of the document is detected at the home 20 position by the detecting means, and means for forming the image of the document on the image carrier in accordance with the size of the document determined by the determining means.

Another object of the present invention can be achieved by an image forming apparatus capable of continuously forming images of a document on a first and a second image carriers, the document having a first image and a second image, comprising means for setting a function of continuously forming the first and second images of the document on the first and second image carriers, respectively, means for detecting a size of the document, means for detecting the second image of the document based on the size of the document detected by the size detection means, and means for canceling the function set by the setting means when the second image detecting means detects the absence of the second image of the document.

BRIEF DESCRIPTION OF THE DRAWINGS

FIGS. 1 to 16B-II show an embodiment of an image forming apparatus according to the present invention and FIGS. 17 to 18C-II show another embodiment of an image forming apparatus according to the present invention, in which:

FIG. 1 is a perspective view showing an outer appearance of an image forming apparatus according to the present invention;

FIG. 2 is a side sectional view of the image forming apparatus shown in FIG. 1;

FIG. 3 is a plan view showing an arrangement of an operation panel of the image forming apparatus shown in FIG. 1;

FIG. 4 is a perspective view schematically showing a drive mechanism of an optical system of the image forming apparatus shown in FIG. 1;

FIG. 5 is a view showing a state wherein a copying range determined in correspondence with paper P of a designated size is indicated on a document table;

FIG. 6 is a sectional view for explaining an arrangement of a document size detector of the image forming apparatus shown in FIG. 1;

FIG. 7 is a circuit diagram showing in detail electrical circuit of the document size detector shown in FIG. 6;

FIG. 8 is a graph showing reflection spectral characteristics with respect to a document and a document cover;

FIG. 9 is a view for explaining an operation of the document size detector of the image forming apparatus shown in FIG. 1;

FIG. 10 is a block diagram showing a main part of a control circuit of the image forming apparatus shown in FIG. 1;

FIG. 11 is a table logically showing discrimination 20 data used in size determination of a document;

FIG. 13 is a view for explaining a detection operation of an A3-size document;

FIG. 14 is a view for explaining a detection operation of a longitudinally placed A4-size document;

FIGS. 16A-I to 16B-II are flow charts for explaining a detection operation of a document size considering a copying magnification;

FIGS. 18A to 18C-II are flow charts for explaining a continuous page copying operation.

DETAILED DESCRIPTION OF THE PREFERRED EMBODIMENTS

An image forming apparatus according to the present invention will be described hereinafter with reference to the accompanying drawings.

Figure 1:
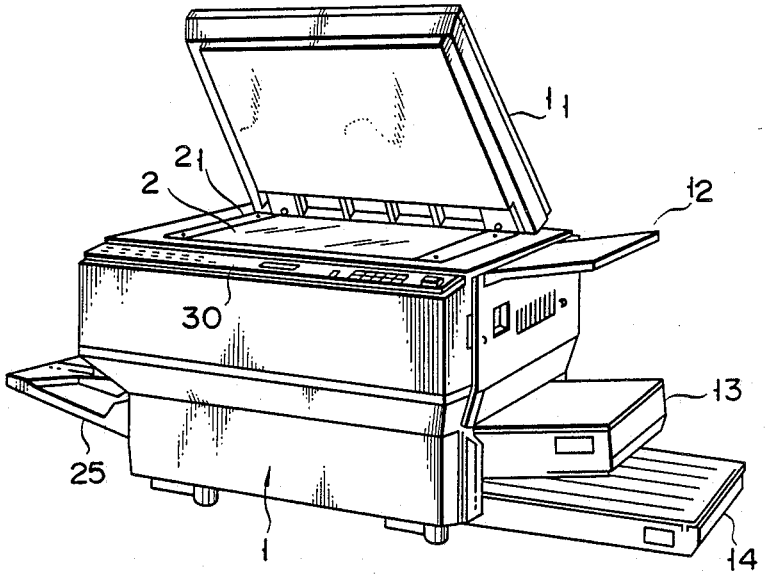
Figure 2:
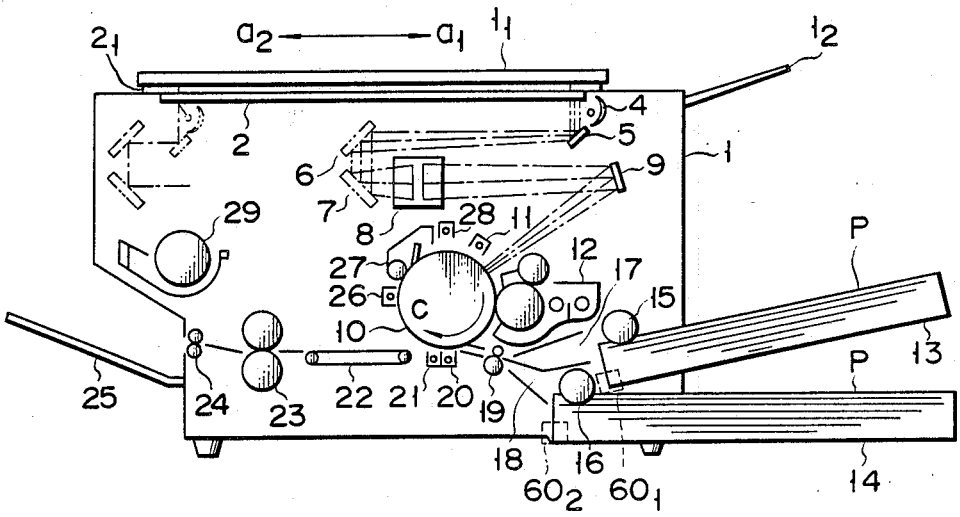

A first embodiment will be described first. FIG. 1 15 shows an outer appearance of an image forming apparatus of the present invention, e.g., an electronic copying machine. Document table (transparent glass) 2 on which a document (not shown) is placed is fixed on the upper surface of copying machine main body 1. Stationary scale 21 indicating a set reference position of a document is provided to document table 2. Openable/ closable document cover 11 and work table 12 are arranged near document table 2. As shown in FIG. 2, when a document is placed on document table 2, an optical system consisting of exposure lamp 4 and mirrors 5, 6, and 7 is reciprocated in directions indicated by arrows a1 and a2 along the lower surface of document table 2 so as to scan the document. In this case, mirrors 6 and 7 are moved at a speed ½ that of mirror 5 so as to maintain a predetermined optical path length. Light reflected by the scanned document, i.e., light reflected by the document upon light radiation of exposure lamp 4, is reflected by mirrors 5, 6, and 7, passes through magnification change lens block 8, and is then reflected by mirror 9. Thereafter, the light is guided to photosensitive drum 10, the surface of which is precharged by charger 11. A document image is formed on the surface of photosensitive drum 10, thus forming a so-called electrostatic latent image. Photosensitive drum 10 is normally rotated in a direction indicated by arrow c. The latent image is visualized by toner supplied from developing unit 12.

In FIG. 2, paper feed cassettes 13 and 14 are detachably attached to a right lower end portion of main body 1. One of cassettes 13 and 14 can be selected by an operation panel (to be described later). Cassette sizes of cassettes 13 and 14 are respectively detected by cassette size detection switches 601 and 602. Each of switches 601 and 602 comprises a plurality of microswitches which are turned on/off in accordance with insertion of cassettes of different sizes.

Paper sheet (recording material) P is picked up one by one from selected upper or lower paper feed cassette 13 or 14 by pickup rollers 15 or 16. Picked-up paper sheet P is guided to register roller pair 19 along paper guide path 17 or 18, and is then guided by register roller pair 19 to a transfer unit including transfer charger 20. Paper sheet P fed to the transfer unit is brought into tight contact with the surface of photosensitive drum 10 by transfer charger 20, so that a toner image is transferred thereon. Paper sheet P on which the toner image was transferred is statically peeled from drum by peeling charger 21, and is fed by conveyor belt 22 toward fixing rollers 23 as a fixing device arranged at a trailing end portion of belt 22. Paper sheet P on which the transfer image is fixed by fixing rollers 23 is exhausted by exhaust roller pair 24 onto tray 25 arranged outside main body 1.

After the transfer operation, photosensitive drum 10 is discharged by discharger 26, and residual toner is removed from its surface by cleaner 27. Thereafter, an after-image is erased by discharging lamp 28. Drum 10 is then turned to an initial state. Note that reference numeral 29 denotes a cooling fan for preventing an increase in temperature in main body 1.

Figure 3:
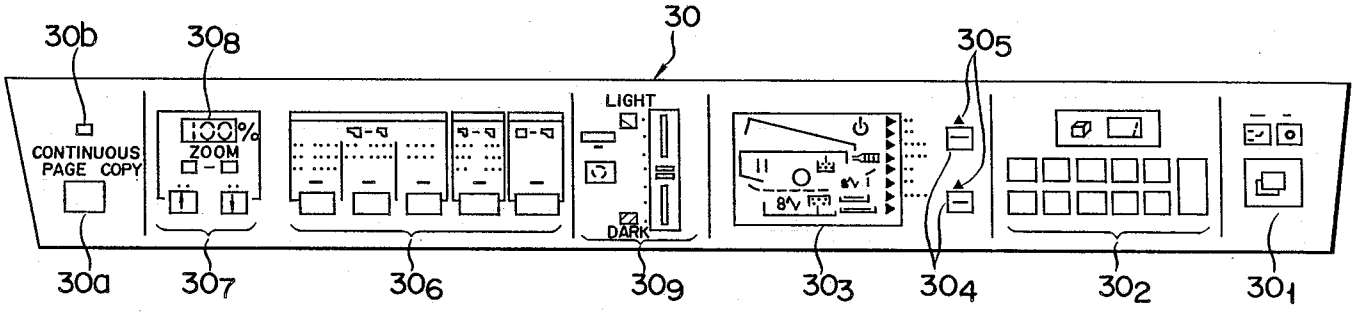

FIG. 3 shows operation panel 30 provided to main body 1. Reference numeral 301 denotes a copy key for instructing start of a copying operation; 302, a ten-key pad for setting a copy count; and 303, a display unit for displaying operation states of respective units of main body 1 and paper jam. Reference number 304 denotes cassette selection keys for selecting upper and lower paper feed cassettes 13 and 14; 305, cassette indicators for indicating a selected cassette; and 306, magnification setting keys for setting an enlargement/reduction magnification of a copying operation based on a predetermined relationship. Reference numeral 307 denotes zoom keys for setting a stepless enlargement/reduction magnification: 308, a display unit for displaying a set magnification; and 309, a density setting unit for setting a copying density. Reference numeral 30*a* denotes a function setting key as a means for setting a continuous page copying function capable of continuously copying images on first and second pages of document G placed on document table 2 on first and second paper sheets P; and 30*b*, an indicator for indicating selection of the continuous page copying function.

Figure 4:
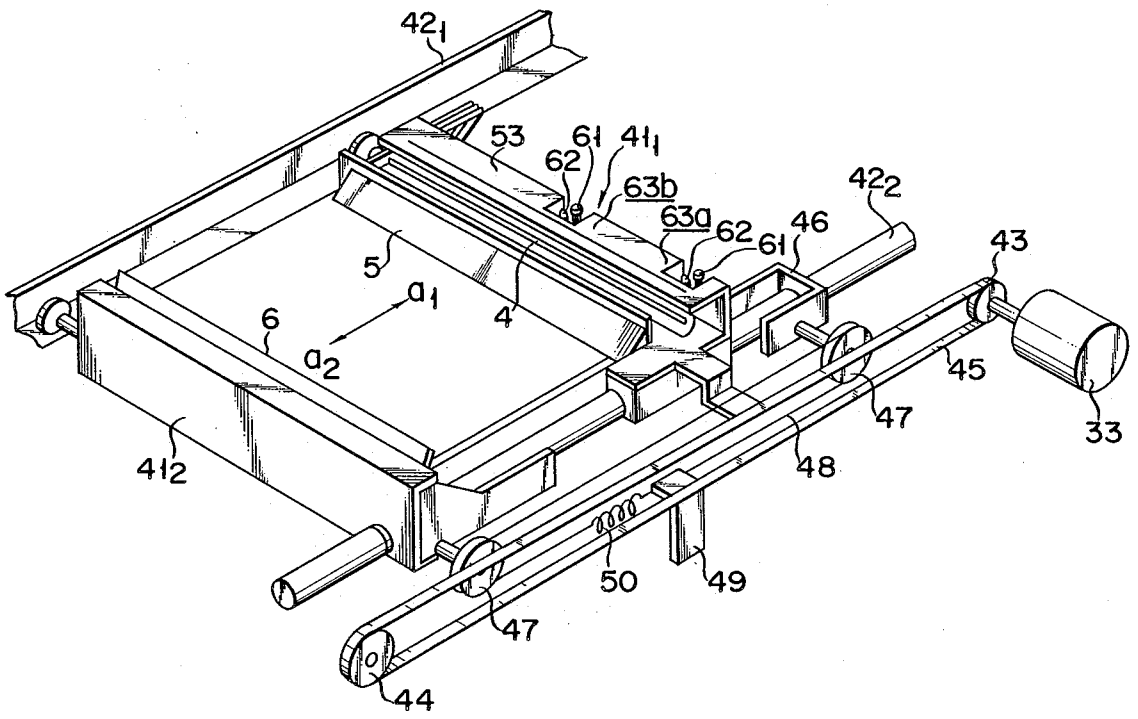

FIG. 4 shows a drive mechanism for reciprocally moving the optical system. More specifically, mirror 5 and exposure lamp 4 are supported on first carriage 411, and mirrors 6 and 7 are supported on second carriage 412. First and second carriages 411 and 412 are guided by guide rails 421 and 422 and are parallely movable in directions indicated by arrows a1 and a2. Four-phase stepping motor 33 drives pulley 43. Endless belt 45 is looped between pulley 43 and idle pulley 44, and one end of first carriage 411 supporting mirror 5 is fixed to an intermediate portion of belt 45.

Two pulleys 47 are rotatably arranged on guide portion 46 of second carriage 412 supporting mirrors 6 and 7 to be separated from each other in the axial direction of rail 422. Wire 48 is looped between these pulleys 47. One end of wire 48 is fixed to fixing portion 49 and the other end thereof is fixed thereto through coil spring 50. One end of first carriage 411 is fixed to an intermediate portion of wire 48. Therefore, when stepping motor 33 is rotated, belt 45 is rotated and first carriage 411 is moved. Thus, second carriage 412 is also moved. In this case, since pulleys 47 serve as a running block, second carriage 412 is moved at a speed ½ that of first carriage 411 in the same direction as the first carriage. Note that the moving direction of first and second carriages 411 and 412 is controlled by switching the rotational direction of stepping motor 33.

Figure 5:
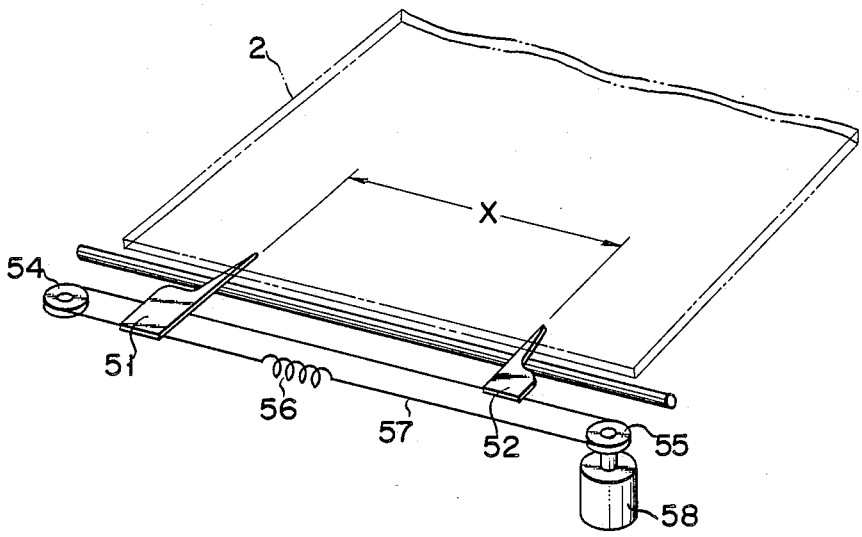

FIG. 5 shows a state wherein a copying range (image 20 forming range of a document) determined in correspondence with the designated size of paper sheet P is indicated on document table 2. More specifically, a copying range is represented by (x,y), a paper size selected by cassette selection key 304 is represented bY (Px,Py), and a copying magnification designated by one of magnification setting keys 306 and zoom keys 307 is represented by K. Thus, the copying range (x,y) is defined by "x=Px/K" and "y=Py/K". In the copying range (x,y), an x-direction is indicated by a distance between pointers 51 and 52 disposed on the lower surface of document table 2, and a y-direction is indicated by a distance between scale 53 arranged on the upper surface portion of first carriage 411 in FIG. 4 and stationary scale 21 (FIG. 2).

Pointers 51 and 52 are provided to wire 57 looped between pulleys 54 and 55 through spring 56, as shown in FIG. 5. Pulley 55 is rotated by motor 58. When motor 58 is driven in accordance with the obtained copying range in the x-direction, the distance between pointers 51 and 52 can be changed.

As shown in FIG. 4, first carriage 411 is moved to a home position according to a magnification (e.g., detection position X shown in FIG. 14) when motor 33 is driven in accordance with a paper size and a copying magnification. Upon scanning of a document, first carriage 411 is moved from the home position in a direction of second carriage 412 (a direction of arrow a2) as a direction of a scanning start position. Thereafter, exposure lamp 4 is turned on, and carriage 411 is moved from the scanning start position in a direction (direction of arrow al) away from second carriage 412. In this manner, when scanning of the document is completed, exposure lamp 4 is turned off, and first carriage 411 is returned to the home position.

Figure 6:
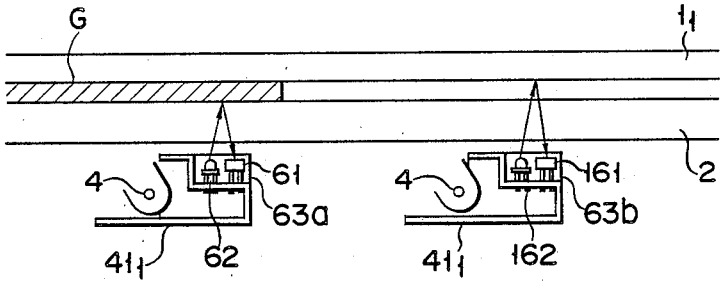

Prior to scanning a document, the document size is detected in advance. More specifically, document detector **63*a* (63*b*) consisting of photosensor 61 (161), light emitting diode 62 (162), and the like is provided to first carriage 411, as shown in FIG. 6. In document detector 63*a* or 63*b*, light reflected by document (white document) G or document cover 11 upon light radiation from light-emitting diode 62 (162) is received by photosensor 61 (161) through document table 2, as shown in FIG. 6. Photosensor 61 (161) converts the reflection light into electrical signals according to reflectivity of document G or document cover 11**.

Figure 7:
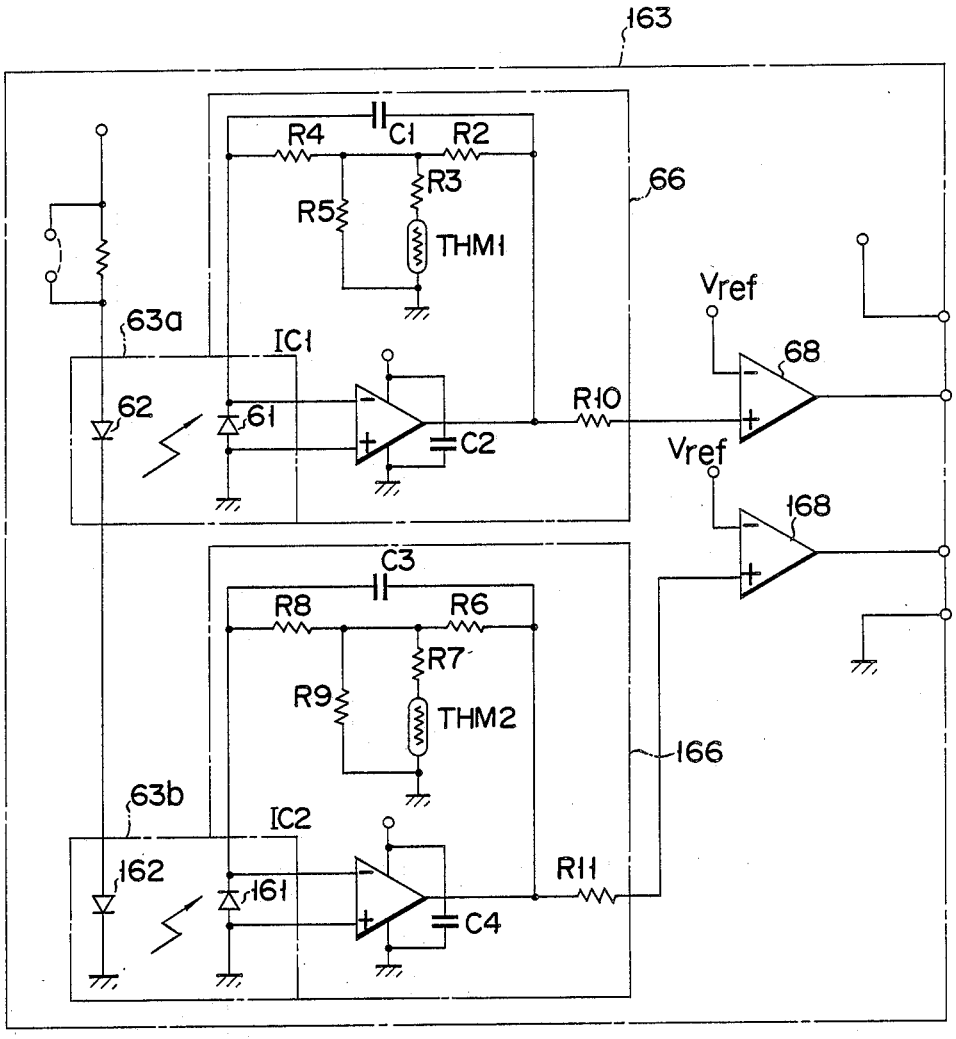

FIG. 7 shows in detail document detection circuit 163 including document detectors **63*a* and 63*b*. Document detector 63*a* consists of light-emitting diode 62 and photosensor 61. Both ends of photosensor 61 are connected to two input terminals of operational amplifier ICl, respectively. Capacitor C2 is connected between two input voltages of operational amplifier ICl, one of which is grounded. Between anode of photosensor 61 and the output of operational amplifier ICl, capacitor C1 and series circuit constituted by resistor; R2 and R4 are connected. One end of the series circuit constituted by resistor R3 and thermistor THMl, which serves to compensate for a change in characteristics of photosensor 61, is connected between resistors R2 and R4, and the other end thereof is grounded. Further one end of resistor R5 is connected between resistors R2 and R4, the other end of which is grounded. Cathode of photosensor 61 is grounded. The output of operational amplifier ICl is connected to one end of protection resistor 10 and the other end thereof is connected to the noninverting input of comparator 68. The inverting input of comparator 68 is connected to a reference voltage source Capacitors C1 and C2, resistors R2, R3, R4, R5, and R10, thermistor THMl, and operational amplifier ICl constitute current voltage converter 66**.

Figure 9:
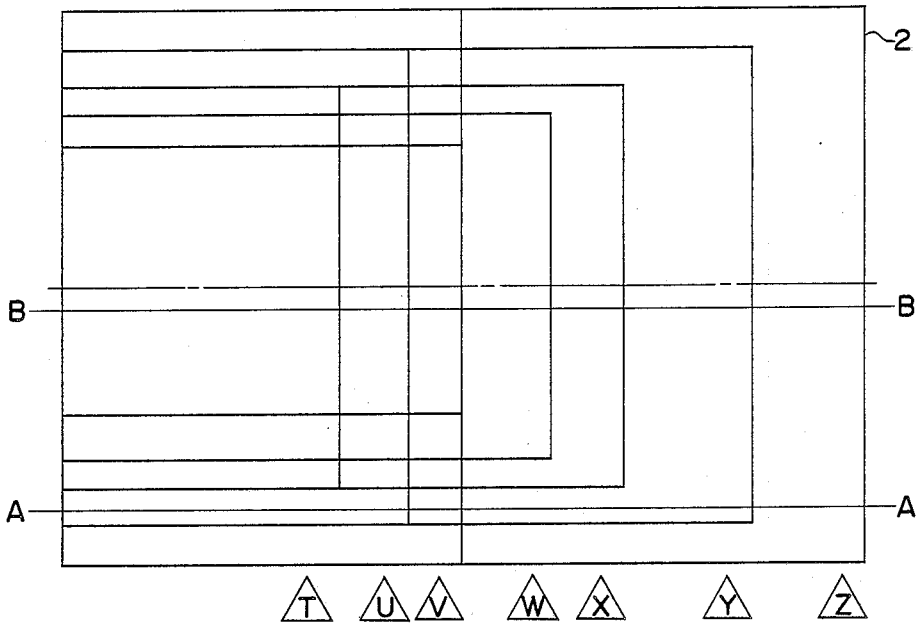

Document detector **63*b* has the same circuit arrangement as document detector 63*a*. The operation of circuit 163 will be described below. As described above, light reflected by document (white document) G or document cover 11 upon light radiation from light-emitting diode 62 (162) is received by photosensor 61 (161) through document table 2. Photosensor 61 (161) then generates an electrical current according to the reflection light. The voltage difference caused by the flowing current between anode and cathode of photosensor 61 is amplified by operational amplifier ICl. This amplified voltage is compared with a reference voltage by comparator 68. The comparison result is supplied to a processor group (to be described later) through an interface (not shown) including a level adjuster. The presence/absence of document G is identified by the processor group, and its size is automatically determined. The detection operation of document detectors 63*a* and 63*b* will be described in detail below with reference to FIG. 9. Document detectors 63*a* and 63*b* of first carriage 411 are arranged to be movable (be able to scan) along straight lines A—A and B—B with respect to document table 2, respectively, as shown in FIG. 9. "A5"- to "A3"-size documents can be placed on document table 2, and any document is placed with reference to the center (indicated by an alternate long and short dashed line in FIG. 9) of document table 2**.

In FIG. 9, reference symbols T, U, V, W, X, Y, and Z indicate detection positions of document sizes by first carriage 411. A difference in output level from photosensor 61 (161) of document detector **63*a* (63*b*) when first carriage 411 has reached one of these detection positions T to Z, i.e., a difference in reflectivity from document (white document) G or document cover 11** is checked, and the presence/absence of document G is determined based on the checking result.

Figure 8:
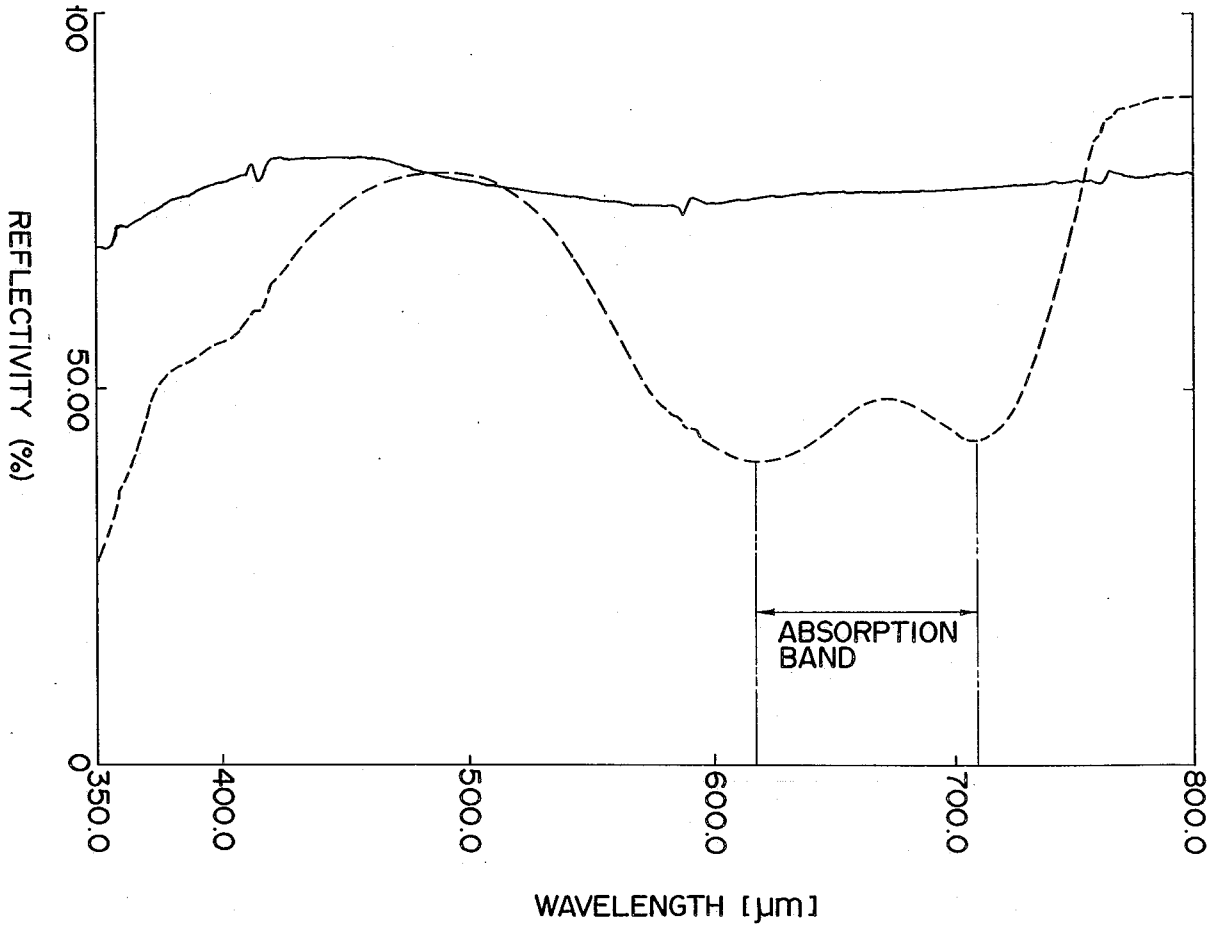

A difference in reflectivity from document (white document) G or document cover 11 will be explained below referring to FIGS. 6 and 8. The rear surface portion of document cover 11 is colored in a color having high sensitivity with respect to photosensitive drug 10. For example, when drum 10 comprises a selenium-based photoconductor, the rear surface portion of document cover 11 is colored in light blue. This is because a blue image is difficult to be formed on drum 10 comprising a selenium-based photoconductor, that is, blue having high sensitivity with respect to selenium-based drum 10 is not almost exposed Therefore, when a fluorescent lamp is used as exposure lamp 4, light blue is processed like white, so that the color of document cover 11 does not influence a copied image.

In contrast to this, light-emitting diode 62 emits light in a wavelength range wherein a difference from white of document G significantly appears in consideration of spectral characteristics of reflection light with respect to the color (light blue) of document cover 11. More specifically, light blue has spectral characteristics of reflectivity, as indicated by a dotted curve in FIG. 8. As can be seen from FIG. 8, a reflectivity of light blue with respect to a wavelength range of about 600.0 μm to 700.0 μm, i.e., red to orange light 20 components is about ½ that of while indicated by a solid curve in FIG. 8. When drum 10 comprises a selenium-based photoconductor, the rear surface portion of document cover 11 is colored in light blue. Document cover 11 colored in light blue has low reflectivity with respect to radiation of red to orange light components. For this reason, the output level of photosensor 61 (161) is lower when document cover 11 is detected than when document G is detected. Thus, document G and document cover 11 can be easily identified by visible light photosensors based on a difference in reflectivity without influencing a copied image. Therefore, an inexpensive photosensor can be used as photosensor 61 (161), and a document size can be automatically detected with low cost.

Figure 10:
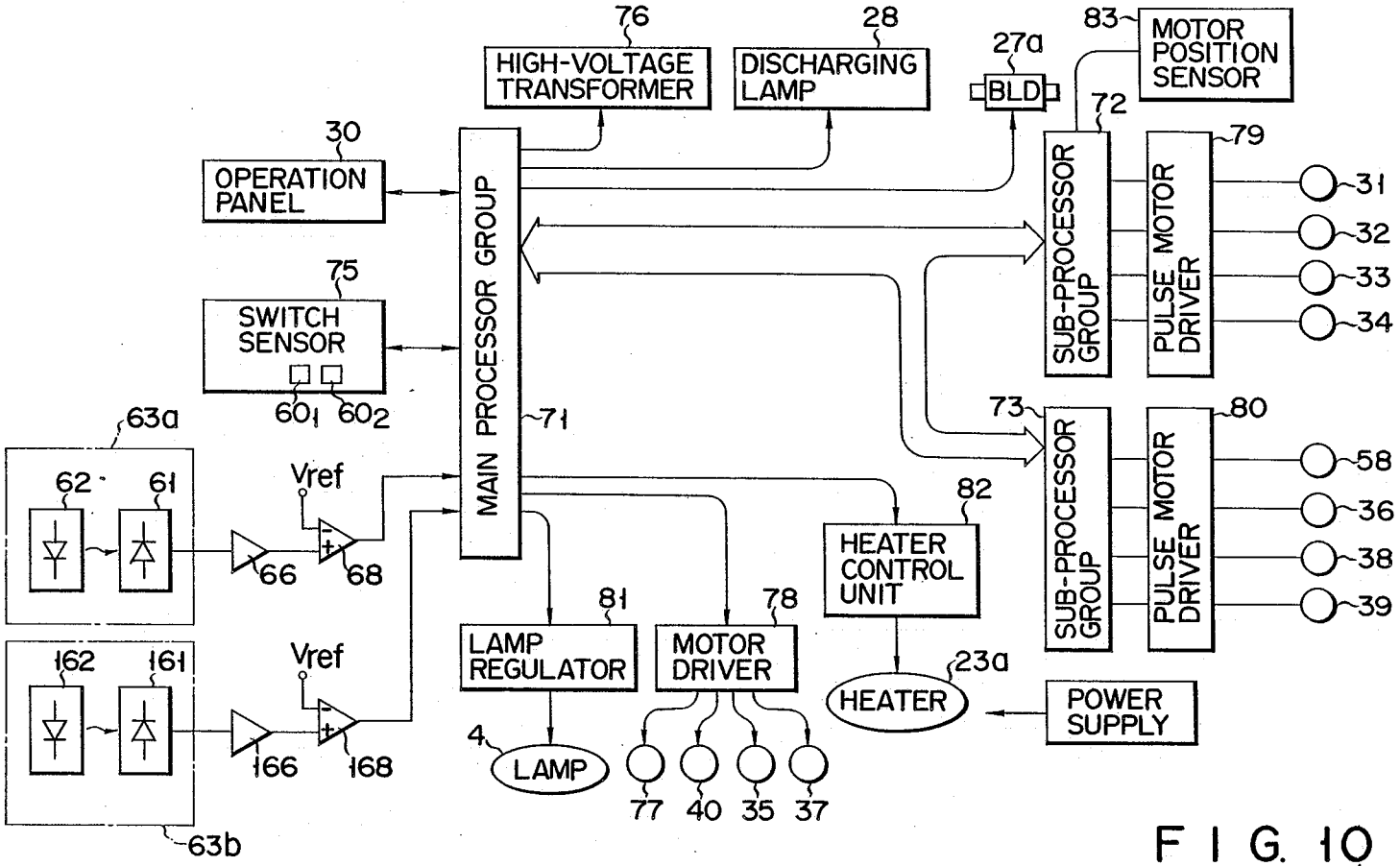

FIG. 10 shows a principal part of a control circuit. Main processor group 71 detects inputs from operation panel 30 and various switches and sensors, e.g., cassette size detection switches 601 and 602, and controls high-voltage transformer 76 for driving the above-mentioned chargers, discharging lamp 28, blade solenoid 27*a* of cleaner 27, heater 23*a* of fixing roller pair 23, exposure lamp 4, motors 31 to 40, 58, and 77, and the like, thus performing the copying operation described above. When the continuous page copying mode is selected upon operation of function setting key 30*a* of operation panel 30, main processor group 71 performs the continuous page copying operation so that images on first and second pages of document G placed on document table 2 are continuously copied on first and second paper sheets P.

Document detector 63*a* (63*b*) comprising light emitting diode 62 (162) for radiating red to orange light components to document G or document cover 11 colored in light blue and photosensor 61 (161) for receiving light reflected by document G or document cover 11 upon light radiation from diode 62 (162), supplies its output to main processor group 71 through amplifier 66 (166) for converting an output from photosensor 61 (161) into a voltage signal, and comparator 68 (168) for comparing the output received from sensor 61 (161) through amplifier 66 (166) with a reference voltage (Vref) for compensating for a variation in sensor sensitivity or a variation in output level of the sensor caused by a change in temperature. In a copying operation in the continuous page copying mode, a document size is detected based on outputs from document detectors 63*a* and 63*b* prior to document scanning. When the presence of the second page cannot be detected in accordance with the detected document size, i.e., when a single document which is not suitable for the continuous page copying operation is detected based on the document size, the continuous page copying mode is automatically canceled.

Motor 31 is a lens motor for moving the position of lens block 8 in a variable magnification mode, motor 32 is a mirror motor for changing a distance (optical path length) between mirror 5 and mirrors 6 and 7 in the variable magnification mode, motor 33 is a scanning motor for moving first carriage 411, motor 34 is a shutter motor for moving a shutter (not shown) for adjusting a charging width by charger 11, motor 35 is a developing motor for driving developing rollers and the like of developing unit 12, motor 36 is a drum motor for driving photosensitive drum 10, motor 37 is a fixing motor for driving conveyor belt 22, fixing roller pair 23 and exhaust roller pair 24, motor 38 is a paper feed motor for driving pickup rollers 15 and 16, motor 39 is a paper feed motor for driving register roller pair 19, and motor 40 is a fan motor for driving cooling fan 29. Of motors 31 to 40 and 58, motors 35, 37, and 40, and toner motor 77 for supplying toner to developing unit 12 are controlled by main processor group 71 through motor driver 78, motors 31 to 34 are controlled by first subprocessor group 72 through pulse motor driver 79, and motors 36, 39, 38, and 58 are controlled by second subprocessor group 73 through pulse motor driver 80.

Stepping motor 33 is controlled by processor group 71 through stepping motor driver 72. In a discrimination operation for detecting a document size, the rotational direction of stepping motor 33 is controlled in accordance with the detection result of document G by document detectors 63*a* and 63*b* at the home position of first carriage 411. More specifically, when document G is detected at the position of first carriage 411 (e.g., detection position V shown in FIG. 13) when copy key 301 of operation panel 30 is operated, stepping motor 33 is rotated to move first carriage 411 from the detected position in a direction (al direction) opposite to the scanning start position, i.e., away from second carriage 412. When no document G is detected at the position of first carriage 411 (e.g., detection position X shown in FIG. 14) when copy key 301 of operation panel 30 is operated, stepping motor 33 is rotated to move first carriage 411 from the detected position toward second carriage 412, i.e., toward the scanning start position (a2 direction).

Exposure lamp 4 is controlled by main processor 10 group 71 through lamp regulator 81, and heater 23*a* is controlled by processor group 71 through heater control unit B2. Main processor group 71 supplies motor drive/ stop instructions to first and second sub-processor groups 72 and 73. First and second sub-processor groups 72 and 73 supply status signals indicating drive/-stop states of the motors to main processor group 71. First sub-processor group 72 receives position data from position sensor 83 for detecting initial positions of motors 31 to 34. Each of first and second sub-processor groups 72 and 73 comprises a microcomputer, a programmable interval timer for counting reference clock pulses in accordance with a setting value supplied from the microcomputer so as to control switching intervals of pulse motors, and the like.

The count result of the reference clock pulses is supplied from first and second sub-processor groups 72 and 73 to main processor group 71.

Note that main processor group 71 comprises a RAM (random access memory) storing position data for detecting the position (detection position) of first carriage 411 based on count data obtained by counting the number of pulses from first sub-processor group 72 to motor 33, and a ROM (read-only memory) storing identification data for detecting a document size in accordance with the output level of photosensor 61 (161) when first carriage 411 is located at each detection position obtained based on the position data.

Processor group 71 is connected to pulse counter 73 for counting the number of pulses supplied to stepping motor driver 72, and memory 74 storing various data subjected to size determination of a document. Memory 74 comprises a RAM (random access memory) storing position data (detection position) indicating the position of first carriage 411 in accordance with a pulse count, and a ROM (read-only memory) storing discrimination data for determining a document size in accordance with a combination of the position data and the output level of photosensor 61 (161).

Figure 13:
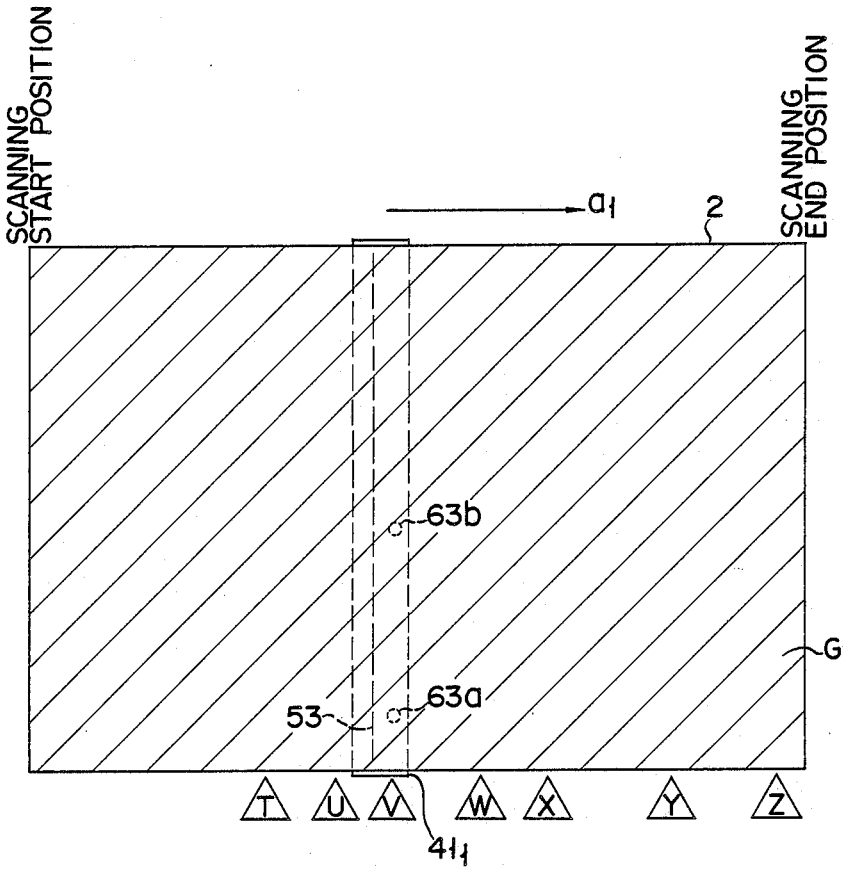

FIG. 11 logically illustrates discrimination data obtained when photosensor 61 of document detector 63*a* is moved along line A—A of document table 2 and when photosensor 161 of document detector 63*b* is moved along line B—B, as shown in FIG. 9. Processor group 71 determines a document size with reference to the discrimination data. More specifically, various document sizes are determined based on the detection position (position data) of first carriage 411 and the output levels of photosensors 61 and 161 of document detectors 63*a* and 63*b* at that time. In FIG. 11, the output levels of photosensor 61 moved along line A—A of document table 2 at respective detection positions in correspondence with various document sizes, and the output levels of photosensor 161 of document detector 63*b* moved along line B—B of document table 2 at respective detection positions in FIG. 13 are represented by marks "o" and "x". Mark "o" represents the output level according to reflection light from document G, i.e., a case wherein document G is detected, and mark "x" represents the output level according to reflection light from document cover 11, i.e., a case wherein document cover 11 is detected.

A determination operation when a document size is automatically detected by document detectors 63*a* and 63*b* described above will be explained below. Processor group 71 discriminates the position of first carriage 411 based on the count data (pulse count) supplied from pulse counter 73 and the position data stored in memory 74, and determines a document size based on the output levels of photosensors 61 and 161 at detection positions T, U, V, W, X, Y, and Z and the discrimination data stored in memory 74. More specifically, upon radiation of red to orange light components from light-emitting diode 62 (162), reflection light corresponding to white from document G and reflection light corresponding to light blue from document cover 11 are incident on photosensor 61 (161). In this case, as described above, document cover 11 colored in light blue has low reflectivity with respect to radiation of red to orange light components. For this reason, as compared to light reflected by document G, the output from photosensor 61 (161) is lowered. Therefore, document G and document cover 11 can be easily identified based on the output level from photosensor 61 (161), and the size of document G can be determined by detecting the presence/ absence of document G for respective detection positions T to Z.

Figure 12A:
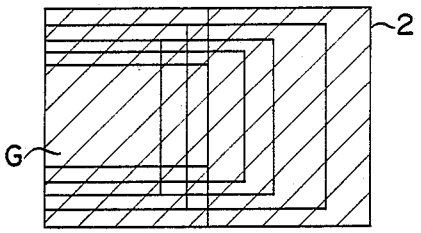
FIGS. 12A to 12H are views for explaining a determination operation of a document size.
Figure 12B:
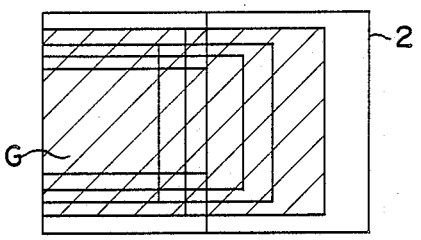
Figure 12C:
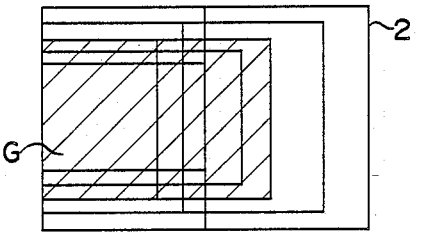
Figure 12D:
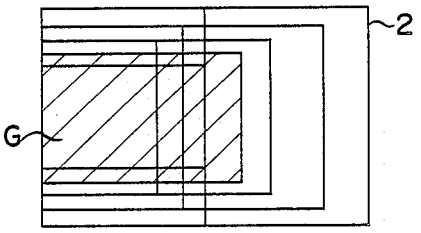

For example, when "A3"-size document G is placed on document table 2, as shown in FIG. 12A, document G is detected (indicated by marks "o") by document detectors 63*a* and 63*b* when moving first carriage 411 is located at any of detection positions T to Z. Such a detection state is established only when document G have an "A3" size, according to FIG. 11. In this case, processor group 71 determines that document G has an "A3" size.

Figure 12E:
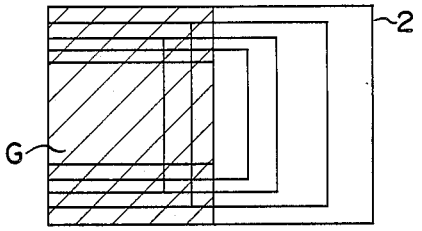
Figure 12F:
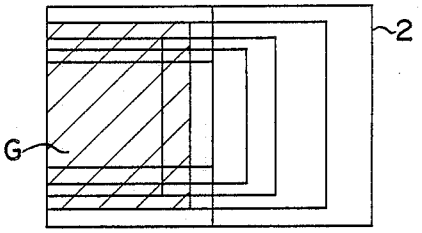
Figure 12G:
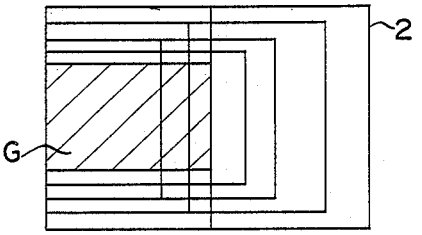

When "longitudinal A4"-size document G is placed on document table 2, as shown in FIG. 12E, document detected (indicated by marks "o") by document detectors 63*a* and 63*b* when moving first carriage 411 is located at any of detection positions T to V, and document cover 11 is detected (indicated by marks "x") by document detectors 63*a* and 63*b* at detection positions W to Z. Such a detection state is established only when document G has a "longitudinal A4" size In this case, processor group 71 determines that document G has a "longitudinal A4" size.

Figure 12H:
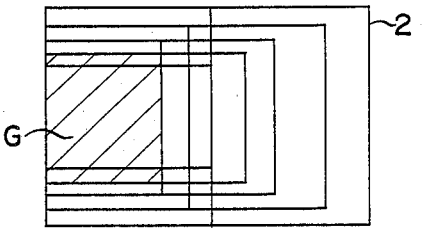

When "longitudinal A5"-size document G is placed on document table 2, as shown in FIG. 12H, document G is detected (indicated by mark "o") by only document detector 63*b* when moving first carriage 411 is located at detection position T, and document cover 11 is detected (indicated by marks "x") by document detector 63*a* located at detection position T and document detector 63*a* located at detection positions U to Z. Such a detection state is established only when document G has a "longitudinal size. In this case, processor group 71 determines that document G has a "longitudinal A5" size.

Note that FIGS. 12B, 12C, 12D, 12F, and 12G respectively illustrate cases wherein "B4"-size, "lateral A4"-size, "lateral B5"-size, "longitudinal A5"-size, and "lateral A5"-size documents G are placed. Therefore, as shown in FIG. 11, the sizes of documents G are accurately detected upon combinations of position data of first carriage 411 and data indicating the presence/ absence of document G, i.e., outputs from two photosensors 61 and 161 at detection positions T to Z.

A document detection operation will be described hereinafter with reference to the flow chart of FIGS. 15A and 15B. Assume that first carriage 411 is located at a home position according to a magnification (e.g., detection position X shown in FIG. 14) in accordance with an input predetermined paper size and magnification. In addition, document G is placed on document table 2, document cover 11 is closed, and copy key 301 of operation panel 30 is depressed. In this case, document detectors 63*a* and 63*b* are operated to check the presence/absence of document G at the home position of first carriage 411 (indication position of the copying range by scale 63). More specifically, upon depression of copy key 301 of operation panel 30, light-emitting diode 62 (162) is turned on (step 1), and reflection light from document G or document cover 11 is received by photosensor 61 (161). Reflection light from document G or document cover 11 is photoelectrically converted by photosensor 61 (161), and the electrical signal is converted by amplifier 66 (166) to a voltage signal. The voltage signal is supplied to comparator 68 (168), and is compared with reference voltage Vref. The comparison result, i.e., the output from photosensor 6. (161) corrected based on the reference voltage is supplied to processor group 71. Processor group 71 checks the output levels of photosensors 61 and 161 of document detectors 63*a* and 63*b* so as to determine whether or not document G is located on a document table 2 portion corresponding to the home position of first carriage 411

(step 2). If it is determined in step 2 that document G is located on the document table 2 portion corresponding to the home position (this case is shown in FIG. 13), first carriage 411 is moved from the home position in a direction (direction of arrow a1 in FIG. 4) opposite to the scanning start position, i.e., away from second carriage 412 by stepping motor 33 controlled by processor group 71 through stepping motor driver 72 (step 3). In other words, when document G is detected (indicated by mark "o") at the position of first carriage 411 when copy key 301 is operated, it is determined that document G is larger than the copying range indicated by scale 53 on first carriage 411. Thus, first carriage 411 is moved from that position (home position) in a scanning direction away from second carriage 412. During movement of first carriage 411, it is checked if first carriage 411 has reached one of document detection positions T, U, V, W, X, Y, and Z (step 5). If YES in step 5, the presence/absence of document G is determined at that position (step 6). That is, reflection light components from document G at that position and document cover 11 are received by photosensor 61 (161). If NO in step 6, the output level is set to be mark "x" and step 7 is executed. If YES in step 6, the output level is set to be mark "o" and step 7 is executed. The reflection light components from document G and document cover 11 are photoelectrically converted by photosensor 61 (161), and the electrical signal is converted to a voltage signal by amplifier 66 (166). Thereafter, the voltage signal is compared with reference voltage Vref by comparator 68 (168). The output from photosensor 61 (161) corrected based on reference voltage Vref is supplied to processor group 71.

Processor group 71 receives count data obtained by 10 counting the number of pulses supplied to stepping motor driver 72 by pulse counter 73. Processor group 71 determines the position of first carriage 41 based on the count data (pulse count) supplied from pulse counter 73 and the position data stored in memory 74, and also detects the output levels of photosensors 61 and 161 of document detectors 63*a* and 63*b* at the detection positions along the moving path of first carriage 411. Thus, a document size is determined based on these results and discrimination data stored in memory 74.

For example, as shown in FIG. 13, when "A3"-size document (indicated by a hatched portion) G is placed on document table 2 and first carriage 411 is moved to the home position (detection position V) of a range of a "longitudinal A4"-size document as a copying range, document G is detected (indicated by mark "o") by document detectors 63*a* and 63*b* First carriage 411 is then moved in a direction of arrow a1 in FIG. 13, and scanning for document size detection by document detectors 63*a* and 63*b* is performed. In this case, document G is detected (indicated by marks "o") by document detectors 63*a* and 63*b* when first carriage 411 is located at detection positions V to Z. Such a detection state is established (assuming that document G is also detected at detection positions T and U) only when document G has an "A3" size, as shown in FIG. 11. In this case, processor group 71 determines that document G has an "A3" size.

It is then checked if first carriage 411 has reached the trailing end (scanning end position) of document table 2 (step 7). Step 7 is also executed if it is determined in step 5 that first carriage 411 has reached the document detection position. If YES in step 7, first carriage 411 is moved toward second carriage 412 (direction of arrow a2) by stepping motor 33 controlled by processor 71 through stepping motor driver 72, and is stopped at the scanning start position. If NO in step 7, step 5 is repeated. After execution of step 7, light-emitting diode 62 (162) is turned off (step 8), and stepping motor 33 is also deenergized (step 9), thus completing document detection.

Figure 14:
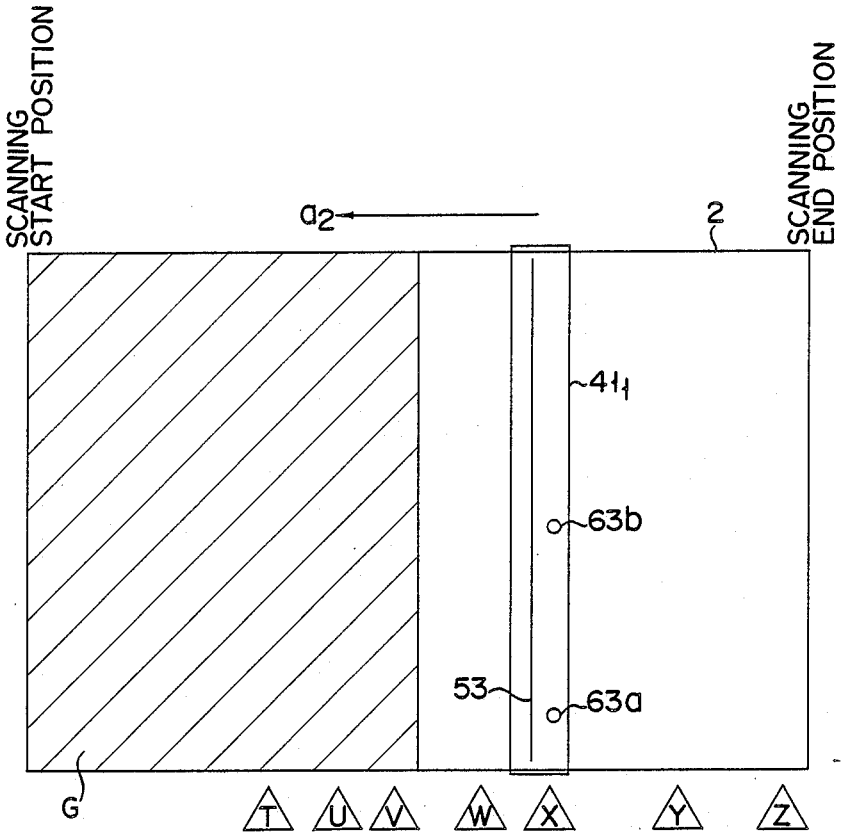
Figure 15A:
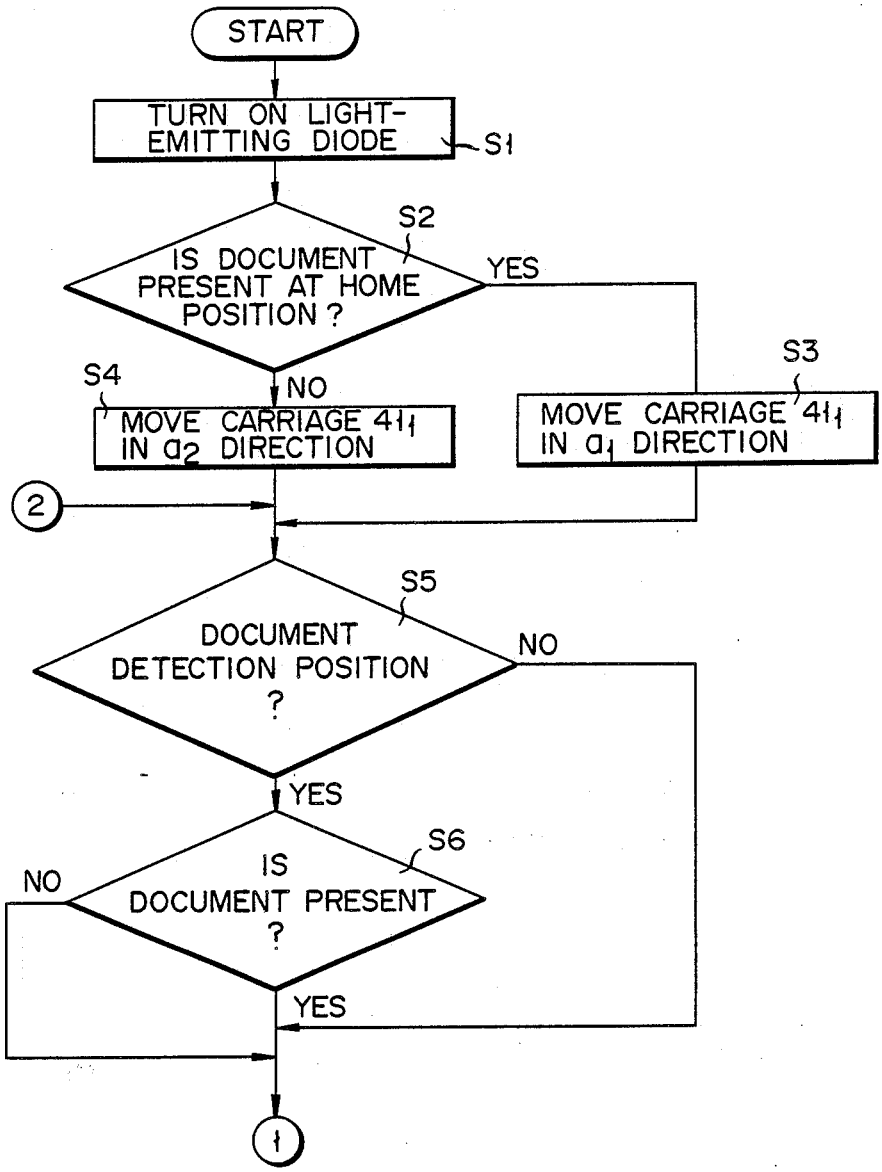
FIGS. 15A and 15B are a flow chart for explaining a detection operation of a document size.
Figure 15B:
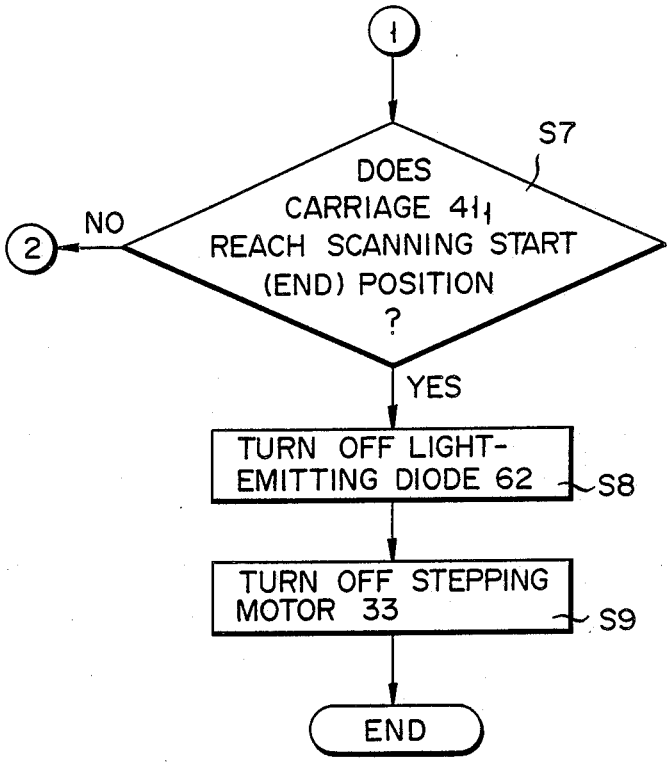
Figures 1, 16B:
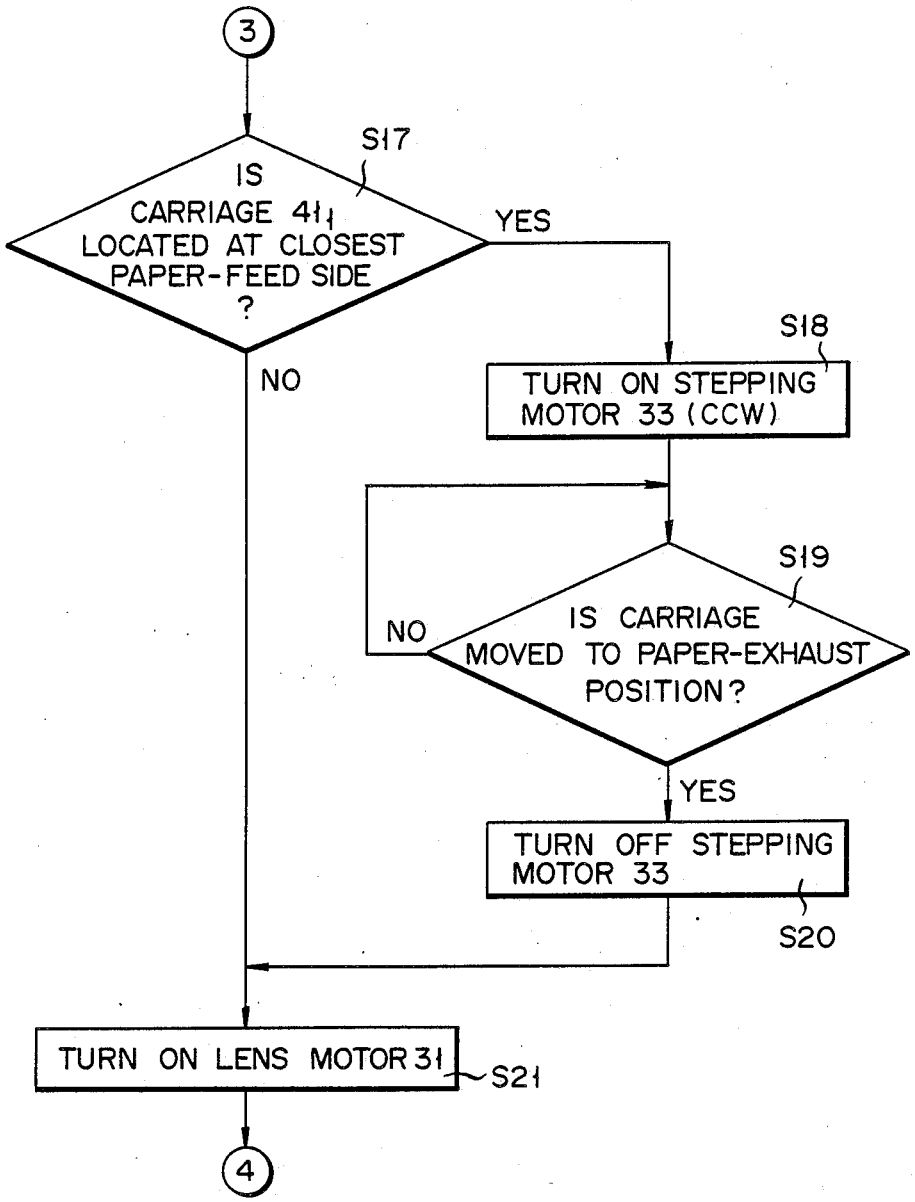

Meanwhile, if it is determined in step 2 that document G is not present on the document table 2 portion corresponding to the home position of first carriage 411 (this case is shown in FIG. 14), first carriage 411 is moved toward the scanning start position (in a direction of arrow a2 in FIG. 4) by stepping motor 33 controlled by processor 71 through stepping motor driver 72. More specifically, when document G is not detected at the position of first carriage 411 when copy key 301 is operated, i.e., when document cover 11 is detected (indicated by mark "x"), it is determined that document G is smaller than the copying range indicated by scale 53 and the like on first carriage 411. First carriage 411 is then moved from that position toward second carriage 412, i.e., toward the scanning start position. Thereafter, steps similar to those executed when a document is detected at the home position are executed. During movement of first carriage 411, reflection light components from document G and document cover 11 upon turning-on of light-emitting diode 62 (162) are received by photosensor 61 (161). The reflection light components from document G and document cover 11 are photoelectrically converted by photosensor 61 (161), and the electrical signal is converted to a voltage signal by amplifier 66 (166). Thereafter, the voltage signal is compared with the reference voltage by comparator 68 (168). The output from photosensor 61 (161) corrected based on reference voltage Vref is supplied to processor group 71.

Processor group 71 receives count data obtained by counting the number of pulses supplied to stepping motor driver 72 by pulse counter 73. Processor group 71 determines the position of first carriage 411 based on the count data (pulse count) supplied from pulse counter 573 and the position data stored in memory 74, and also detects the output levels of photosensors 61 and 161 of document detectors 63*a* and 63*b* at the detection positions along the moving path of first carriage 411. Thus, a document size is determined based on these results and discrimination data stored in memory 74.

For example, as shown in FIG. 14, when "longitudinal A4"-size document (indicated by a hatched portion) G is placed on document table 2 and first carriage 411 is moved to the home position (detection position X) of a range of a "lateral A4"-size document as a copying range, document cover 11 is detected (indicated by marks "x") by document detectors 63*a* and 63*b*. First carriage 411 is moved in the direction of arrow a2 in FIG. 14, and scanning for document size detection by document detectors 63*a* and 63*b* is performed. In this case, when first carriage 411 is located at one of detection positions V to T, document G is detected (indicated by marks ("o") by document detectors 63*a* and 63*b*. Such a detection state is established (assuming that document G is also detected at detection positions W to Z) only when document G has a "longitudinal A4" size, as shown in FIG. 11. In this case, processor group 71 determines that document G has a "longitudinal A4" size.

Note that first carriage 411 is stopped when it has reached the scanning start position.

In this manner, the presence/absence of document G 5 at the position of first carriage 411 when a copy start instruction is input (indication position of the copying range by scale 53) is detected, and the scanning direction (moving direction of first carriage 411) for document size detection is switched in accordance with the detection result. Thus, since movement for document size detection can be started from the current position of first carriage 411, time required for detection can be shortened.

When automatic detection of a document size is 15 completed, first carriage 411 is moved in a direction (direction of arrow al) away from second carriage 412 by stepping motor 33 controlled by processor group 71 through stepping motor driver 72. Exposure lamp 4 is turned on by processor group 71, and upon movement of first carriage 411 from the scanning start position to the scanning end position, image scanning of document G is started. In this case, regardless of a copying range indicated in correspondence with selected paper P, a paper size is automatically selected (in an equal magnification mode) in accordance with a detected document size, a paper size is automatically selected in accordance with a copy size determined based on a document size and a magnification, or a copying magnification is automatically set (in a variable-magnification copying mode) based on a document size and a paper size, thus allowing an efficient image forming operation.

FIGS. 16A-I to 16B-II are flow charts for explaining a document size detection operation considering a copying magnification.

Upon depression of copy key 301, document detectors **63*a* and 63*b* located at a home position (e.g., detection position X shown in FIG. 14) are operated. Thus, light emitting diodes 62 and 162 are turned on (step 1), and document G and document cover 11 are irradiated with light. Light reflected by document G or document cover 11 is detected by photosensor 61 (161), and the level of the detection output is checked by processor group 71, thereby discriminating whether or not document G is present on the current position (step 2). If YES in step 2 (this case is shown in FIG. 13), it is checked if a current magnification is an enlargement magnification (step 3). If YES in step 3, lens motor 31 is turned on (step 4), and lens block 8 begins to move. It is then checked if lens block 8 is moved to a position corresponding to a 100% magnification (step 5). If YES in step 5, lens motor 3 is turned off (step 6). If NO in step 5, step 5 is repeated. Stepping motor 33 is energized (step 7), and first carriage 411 begins to move in the direction of arrow a1 shown in FIG. 2. If the current magnification is not an enlargement magnification, step 7** is also executed.

. If it is determined in step 2 that no document is present at the current position (this case is shown in FIG. 14), stepping motor 33 is energized (step 8), and first carriage 411 begins to move in the direction of arrow a2 in FIG. 2. After steps 7 and 8, it is checked if first carriage 411 has reached any one of the document detection positions (step 9). If YES in step 9, the presence/absence of the document at that position is detected (step 10). If NO in step 10, the output level is set to be mark "x" and step 11 is executed. If YES in step 10, the output level is set to be mark "o" and it is checked if first carriage 411 has reached the scanning start or end position (step 11). Step 11 is also executed when a document cannot be detected at any detection position in step 9. If NO in step 11, step 9 is repeated. If YES in step 11, light-emitting diode 62 (162) is turned off (step 12), and stepping motor 33 is also deenergized (step 13). Thereafter, it is checked if an automatic magnification mode is selected (step 14). If NO in step 14, a cassette is selected (step 15), thus completing document detection. If YES in step 14, a magnification is determined (step 16). It is checked if first carriage 411 is located at the closest paper-feed side (step 17). If YES in step 17, stepping motor 33 is energized (step 18), and first carriage 411 begins to move in the direction of arrow a2 in FIG. 2. Furthermore, it is checked if first carriage 411 has reached a paper-exhaust position (step 19). If NO in step 19, step 19 is repeated. If YES in step 19, stepping motor 33 is deenergized (step 20), and lens motor 31 is energized (step 21). As a result, lens block 8 begins to move. Step 21 is also executed when first carriage 411 has not yet reached the paper-exhaust position. It is checked if lens block B has reached a target magnification position (step 22). If NO in step 22, step 22 is repeated. If YES in step 22, lens motor 31 is deenergized (step 23), and mirror motor 32 is energized (step 24). Thus, magnification change mirrors 5, 6, and 7 begin to move. It is then checked if mirrors 5, 6, and 7 have reached target positions (step 25). If NO in step step 25, step 25 is repeated. If YES in step 25, mirror motor 32 is deenergized (step 26), thus completing document detection. As described above, at the indication position of the image forming range of a document on the document table by an indication means provided to a scanning means, a detection means detects whether or not a document is present on the document table. Thus, the moving direction of the scanning means for document size detection is switched depending on whether the document is detected or not at the indication position. Therefore, document size detection can be started upon movement of the scanning means from the indication position of the image forming range by the indication means.

More specifically, the presence/absence of a document at the position of the first carriage when the copy key is operated is detected, and the scanning direction for document size detection is switched in accordance with the detection result. In this manner, in a copying machine in which a first carriage has a scale indicating a copying range, since the first carriage is located in the middle of a range to be scanned, scanning for document size detection can be started from this position. Therefore, the first carriage need not be returned to the scanning start position each time document size detection is performed, and time required for document size detection can be shortened.

Since the detection time is shortened, an operation time from turning-on of the copy key to completion of the copying operation can be shortened, thus improving copying efficiency.

In the above embodiment, the document cover is colored, light in a wavelength range corresponding to low reflectivity from the document cover is radiated on the document cover and a document, and reflection light components from the document and the document cover are received at visible light photosensors. However, the present invention is not limited to this. For example, light from an exposure lamp is radiated on a document and the colored document cover, and reflection light components from the document and the document cover can be received by color sensors. Alternatively, reflection light components from the document and the document cover can be received by photosensors through a filter corresponding to a wavelength range wherein a difference in reflectivity of reflection light components is conspicuous.

The copying machine in which the photosensitive 10 drum comprises a selenium-based photoconductor has been exemplified. When a photosensitive drum is not of selenium-based type, the present invention can be readily applied by changing the color of the document cover and the color of light radiated from the light-emitting diode.

Upon a document size detection operation, a reference voltage can be read from a reference reflection unit, and a variation in output level of photosensors is corrected with constant reflectivity based on the reference voltage read from the reference reflection unit, so that an erroneous detection caused by a variation in sensor sensitivity or a change in temperature can be prevented.

The document size detection operation can be executed in accordance with mode designation, and can be interrupted when a copying magnification (other than an equal magnification) and a paper size are input. In this case, a copying operation according to arbitrary selection and a copying operation automatically executed according to a document size can be selectively executed.

Figure 18A:
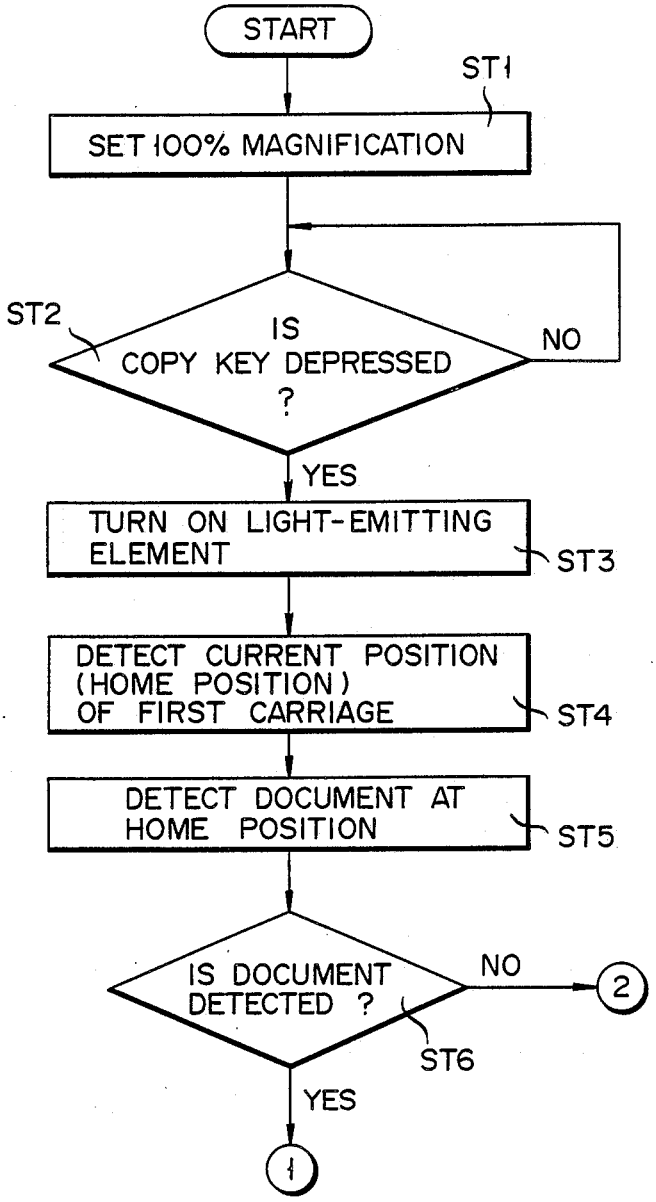
Figures 1, 18B:
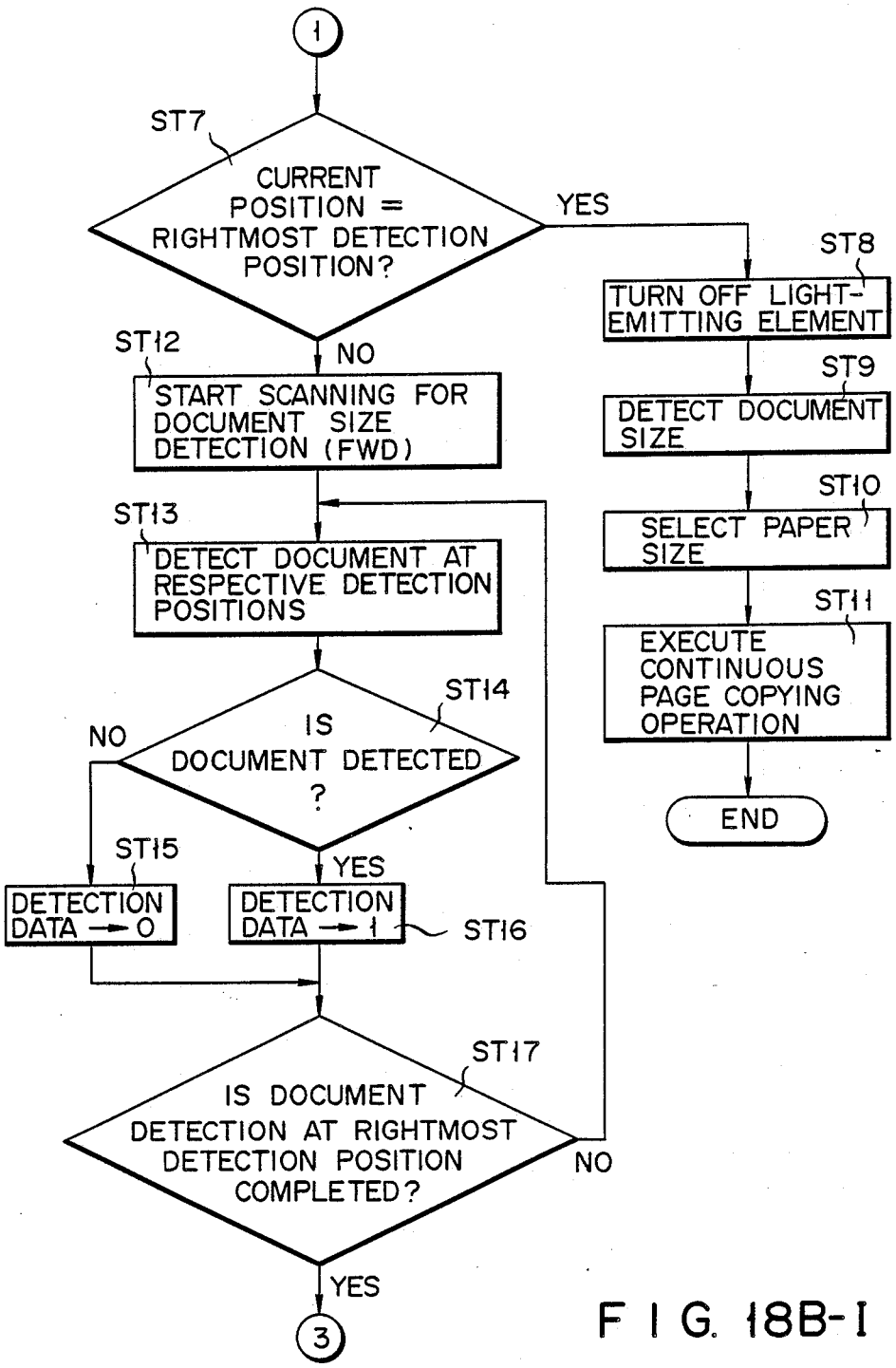

A second embodiment of the present invention will be described hereinafter with reference to the flow charts shown in FIGS. 18A to 18C-II.

Assume that copying machine main body 1 is set in a continuous page copying mode upon operation of function setting key 30*a* of operation panel 30. Thus, the copying magnification is automatically set to be 100% (equal magnification) (step 1).

Figure 17:
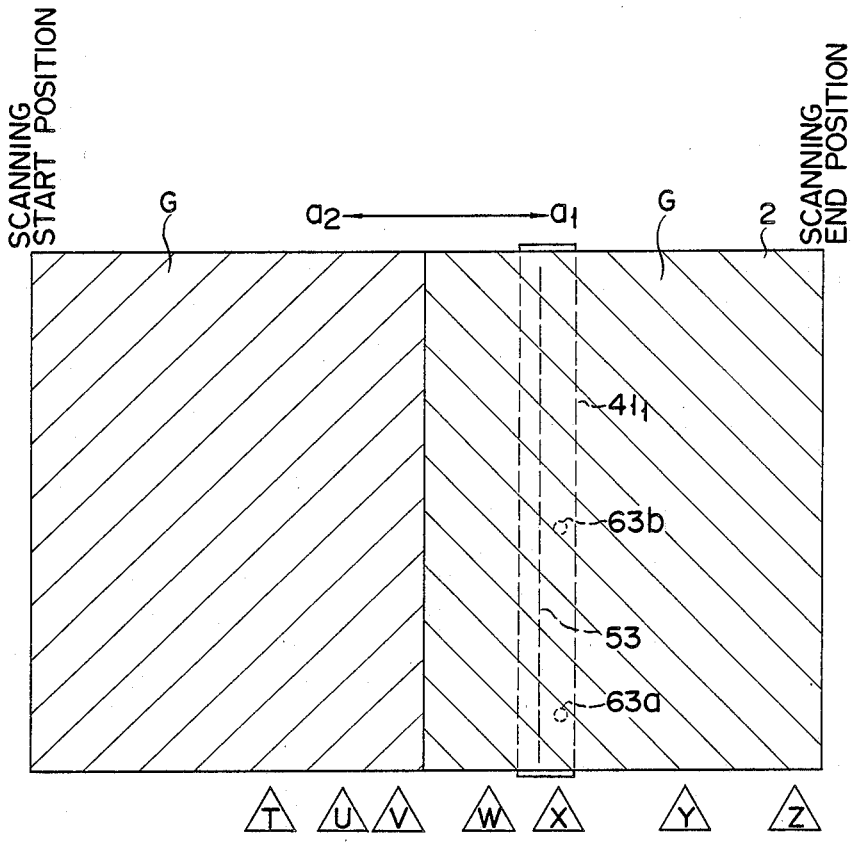
FIG. 17 is a view showing documents which are placed to be subjected to a continuous page copying operation.

In this state, document G is placed on document table 2 shown in FIG. 14 in an open state, as shown in FIG. 17, and copy key 301 for inputting a copy start instruction at operation panel 30 is depressed (step 2). Thus, light-emitting elements 62 and 162 of document detectors 63*a* and 63*b* are turned on (step 3), and light components from these light-emitting elements 62 and 162 are radiated toward document G or document cover 11 at the current 15 position of first carriage 411 waiting at the home position (e.g., detection position X).

The current position (home position) of first carriage 411 is detected based on position data in accordance with the number of pulses supplied to motor 33 (step 4), and the presence/absence of document G at that position is detected (steps 5 and 6). More specifically, the output levels of light-receiving elements 61 and 161 of document detectors 63*a* and 63*b* are checked to detect the presence of document G at the home position.

If the presence of document G at the current position of first carriage 411 is detected in step 6, the current position is checked (step 7). If it is determined that first carriage 411 is moved to the home position corresponding to rightmost detection position Z (shown in FIG. 9), light-emitting elements 62 and 162 of document detectors 63*a* and 63*b* are turned off (step 8). If the presence of document G is detected at detection position Z, it is detected that document G has an "A3" size (step 9). Document G is suitable for a continuous page copying operation. More specifically, first and second "A4"-size pages of document G are assumed to be placed on document table 2, and "A4"-size paper sheet P half the size ("A3") of document G is selected in step 10.

When size detection of document G is performed, first carriage 411 is moved to the document scanning start position, and a copying operation is initiated by document scanning from that position. With the copying operation, images on the first and second pages are formed on paper sheets P selected in step 10 (step 11). In this manner, equal-magnification copies (copied images) including the first and second images corresponding to the first and second pages of "A3"-size document G which are copied on "A4"-size paper sheets P are continuously output, thus completing the operation.

If it is determined in step 7 that first carriage 5 411 is not moved to the home position corresponding to rightmost detection position Z (shown in FIG. 9), first carriage 411 is moved in a direction of arrow a1 (FWD) away from second carriage 412 while light-emitting elements 62 and 162 of document detectors 63*a* and 63*b* are kept on (step 12). Upon movement of first carriage 411, the presence/absence of document G at respective detection positions is detected based on output levels of light-emitting elements 62 and 162 of document detectors 63*a* and 63*b* at the respective detection positions, i.e., from the current position to rightmost detection position Z (steps 13 to 17). More specifically, since the presence/absence of document G is detected at each detection position, when document G is detected, detection data at that detection position is set to be "1", and when not detected, detection data at that position is set to be "0".

After detection of the presence/absence of document G at respective detection positions up to rightmost detection position Z is completed, light-emitting elements 62 and 162 of document detectors 63*a* and 63*b* are turned off (step 18).

When detection of the presence/absence of document G at the respective detection positions is completed, size detection of document G is performed (step 19). In this case, the size of document G is determined based on the rightmost detection position, where the presence of document G is detected, of the detection positions with detection data.

It is checked if the size of document G detected in step 19 is a "B4" size (step 20). For example, the presence of document G is detected at detection position Y, so that it is detected that the size of document G is a "B4" size. Thus, this document G is suitable for a continuous page copying operation, that is, first and second "B5"-size pages of document G are placed on document table 2. In step 21, "B5"-size paper sheet P half the size of document G ("B4") is selected.

When size detection of document G is performed, first carriage 411 is moved to the document scanning start position, and a copying operation is started from that position by document scanning. With the copying operation, images on the first and second pages are formed on paper sheets P selected in step 21 (step 22). In this manner, equal-magnification copies (copied images) including the first and second images corresponding to the first and second pages of "B4"-size document G which are copied on "B5"-size paper sheets P are continuously output, thus completing the operation.

However, if it is detected in step 20 that the size of document G is not a "B4" size, it is determined that document G is not suitable for the continuous page copying operation, and a normal copying operation is performed in the subsequent steps. More specifically, when document G has a size other than a "B4" size and the presence of a second document image cannot be detected, the selected continuous page copying mode is canceled (step 23). A normal copying operation is started by document scanning of first carriage 411 from the scanning start position (step 24). Thus, an image of document G is formed on paper sheet P corresponding to its size, and is output. In this manner, when the presence of a second page is not detected, the continuous page copying mode is canceled, and only an equal-magnification copy of the first page is output, thus completing the operation.

If the presence of document G is not detected at the current position of first carriage 411 in step 6, this current position is checked (step 25). If it is determined in step 25 that first carriage 411 is moved to the home position corresponding to leftmost detection position T (shown in FIG. 9), light-emitting elements 62 and 162 of document detectors 63*a* and 63*b* are turned off (step 26). Since the presence of document G is not detected at detection position T, the operation is completed after determining a size detection error.

If it is determined in step 25 that first carriage 411 is not moved to the home position corresponding to leftmost detection position T (shown in FIG. 9), first carriage 411 is moved in the direction of arrow a2 (BWD) approaching second carriage 412 while light-emitting elements 62 and 162 of document detectors 63*a* and 63*b* are kept on (step 27). Upon movement of first carriage 411, the presence/absence of document G at respective detection positions is detected based on output levels of light-emitting elements 62 and 162 of document detectors 63*a* and 63*b* at the respective detection positions, i.e., from the current position to leftmost detection position T (steps 28 to 32). More specifically, since the presence/absence of document G is detected at each detection position, when document G is detected, detection data at that detection position is set to be "1", and when not detected, detection data at that position is set to be "0".

After detection of the presence/absence of document G at the respective detection positions up to leftmost detection position T is performed, light-emitting elements 62 and 162 of document detectors 63*a* and 63*b* are turned off (step 33).

When detection of the presence/absence of document G at the respective detection positions is completed, size detection of document G is performed step 34). In this case, the size of document G is determined based on the rightmost detection position, where the presence of document G is detected, of the detection positions with detection data "1".

It is checked if the size of document G detected in step 34 is a "B4" size (step 35). For example, the presence of document G is detected at detection position Y, so that it is detected that the size of document G is a "B4" size. Thus, this document G is suitable for a continuous page copying operation, that is, first and second "B5"-size pages of document G are placed on document table 2. In step 36, "B5"-size paper sheet P half the size of document G ("B4") is selected.

When size detection of document G is performed, first carriage 411 is moved to the document scanning start position, and a copying operation is started from that position by document scanning. With the copying operation, images on the first and second pages are formed on paper sheets P selected in step 36 (step 37). In this manner, equal-magnification copies (copied images) including the first and second images corresponding to the first and second pages of "B4"-size document G which are copied on "B5"-size paper sheets P are continuously output, thus completing the operation.

However, if it is detected in step 35 that the size of document G is not a "B4" size, it is determined that document G is not suitable for the continuous page copying operation, and a normal copying operation is performed in the subsequent steps. More specifically, when document G has a size other than a "B4" size and the presence of a second document image cannot be detected, the selected continuous page copying mode is canceled (step 38). A normal copying operation is started by document scanning of first carriage 411 from the scanning start position (step 39). Thus, an image of document G is formed on paper sheet P corresponding to its size, and is output. In this manner, when the presence of a second page is not detected, the continuous page copying mode is automatically canceled, and only an equal-magnification copy of the first page (document G) is output, thus completing the operation.

As described above, in the continuous page copying mode capable of continuously copying images on first and second pages placed on the document table on first and second paper sheets, respectively, a document size is detected at the beginning of the copying operation to check if a second page is present on the document table. If it is determined that no second page is present, the continuous page copying function is automatically canceled so that a copying operation for the second page is not performed.

When a document size is detected and the detected document size is a size other than an "A3" or "B4" size, it is determined that the document is not suitable for the continuous page copying operation, and the continuous page copying is canceled and a normal copying operation is performed. Thus, a copying operation for a second page which does not exist can be prevented. Therefore, when one document (other than an A3 or B4 size) is placed, an unnecessary blank copy which may be formed by an unnecessary copying operation although a document does not exist can be prevented from being output. Thus, waste of expendable supplies such as paper sheets and deterioration of components can be reduced.

Note that the present invention is not limited to the above embodiments, and various changes and modifications may be made within the spirit and scope of the invention.

What is claimed is:

1. A document size detection system for an image forming apparatus, the system comprising:

scanning means for scanning a document from a starting position at one end of the document to the other end;

document size detecting means located on, and movable with, the scanning means, for detecting the document size;

actuating means for moving the document size detecting means from a home position through a plurality of document size detecting positions to the scan starting position;

means for determining whether the document is present at the home position and, accordingly, controlling the direction of movement of the document size detecting means, the direction of movement initially being away form the starting position if the document is present at the home position and initially toward the starting position if it is not present; and means for computing the size of the document from optical signals received by the detecting means.

2. The system of claim 1, wherein the home position is located at or near the middle point of the path traversed by the scanning means.

3. The system of claim 1, wherein the detecting means radiate the document with light and receive reflected light form the document.

4. The system of claim 1, wherein the detecting means includes a plurality of detectors located on one side of the scanning means.

5. The system of claim 1, further including means for supplying paper of appropriate size to receive an image from the document, the paper supply means being responsive to the computing means.

6. The system of claim 1, further including means for selecting the magnification ratio of the image to be formed from the document, this ratio being provided to the computing means.

7. A document detecting system for an image forming apparatus, comprising:

means for positioning first and second documents on the apparatus;

means for scanning the first and second documents from a starting position at the end of the first document;

detecting means mounted on said scanning mans, for detecting the presence of the second document on the apparatus;

means for actuating the detecting means from a position other than the starting position; and means for terminating operation of the scanning when the detecting means no longer detects the presence of the second document.

8. A document size detecting system for an image forming apparatus, the system comprising:

means for detecting the document size;

means for positioning a document to be measured in proximity to the detecting means;

means for moving the detecting means from a home position at or near the center position of the document through a plurality of document size detecting positions;

means for receiving information from the detecting means as the detecting means traverses the document size detecting positions;

means for determining the initial direction of the document size detecting means in response to the length of the document; and means for determining the size of the document from information received by the detecting means.

9. The system of claim 8, further including means for determining if the document, when positioned, is present at the home position.

10. The system of claim 8, further including:

scanning means for scanning an image from the document; and means for moving the scanning means from a starting position at one end of the document to its other end, to form the image on an image carrier.

11. The system of claim 10, further including means for initially moving the detecting means in a direction away from the starting position if the document is present at the home position and moving the detecting means toward the starting position if the document is not present at the home position.

12. The system of claim 8, wherein the detecting means are photoelectric devices that radiate the document with light and receive light reflected by the document.

13. The system of claim 8, wherein the detecting means are located on the scanning means.

14. The system of claim 12, in which the detecting means are located on one side of the scanning means.

15. The system of claim 8, further including:

means for positioning two documents on the apparatus; and means for preventing attempted scanning of the second document if its presence is not detected.

16. A method of determining the size of a document to be reproduced, including the steps of:

(a) placing the document on a surface;

(b) scanning the document along its length by two detecting means, the detecting means indicating the edges of the document by discriminating between light reflected from the document and light reflected by a surface beyond the edges of the document;

(c) determining the direction in which the document will be scanned from a central position on the document in accordance with the length of the document, the initial direction of scanning being toward the nearest end of the document;

(d) scanning the document in accordance with the determination made in step (c); and (e) calculating the size of the document from information detected by the detecting means.

* * * * *